US005966946A

United States Patent [19]

Girard et al.

[11] Patent Number: 5,966,946

[45] Date of Patent: Oct. 19, 1999

[54] METHOD AND APPARATUS FOR RETENTION OF A REFRIGERANT FLUID IN A REFRIGERATION ENCLOSURE

[75] Inventors: John Martin Girard, Westmont; William Michael Blumthal; Gary D. Lang, both of Naperville, all of Ill.; Mark Stephen Nowotarski, Stamford, Conn.

[73] Assignee: Praxair Technology, Inc., Danbury, Conn.

[21] Appl. No.: 09/092,933

[22] Filed: Jun. 8, 1998

[51] Int. Cl.[6] ..... F25D 23/02

[52] U.S. Cl. ..... 62/63; 62/186; 62/266

[58] Field of Search ..... 62/63, 266, 186, 62/64, 374, 395

[56] References Cited

U.S. PATENT DOCUMENTS

| | | | |
|---|---|---|---|
| 3,412,573 | 11/1968 | Pauliukonis | 62/63 |
| 3,701,263 | 10/1972 | Barrett | 62/63 |
| 3,728,869 | 4/1973 | Schmidt | 62/266 |
| 4,356,707 | 11/1982 | Tyree, Jr. et al. | 62/381 |
| 4,528,819 | 7/1985 | Klee | 62/63 |
| 4,739,623 | 4/1988 | Tyree et al. | 62/63 |
| 4,800,728 | 1/1989 | Klee | 62/63 |
| 4,866,946 | 9/1989 | Klee | 62/63 |
| 4,947,654 | 8/1990 | Sink et al. | 62/186 |
| 4,955,206 | 9/1990 | Lang et al. | 62/186 |
| 5,186,008 | 2/1993 | Appolonia et al. | 62/63 |

*Primary Examiner*—William Doerrler
*Attorney, Agent, or Firm*—Blake T. Biederman

[57] ABSTRACT

The method of the invention is based on the comparison of local vapor concentrations at the inlet and outlet refrigeration ports and taking action based on that comparison. Control apparatus incorporating the invention is installed inside a refrigeration enclosure, adjacent to a port, preferably at the lowermost port. If the enclosure contains multiple ports at similar height, then each port has a form of the control apparatus attached to it. The control apparatus adjusts a flow of vapor leaving the interior of the enclosure. The control apparatus includes a duct assembly and a blower system. The bottom portion of the duct assembly is a tunnel enclosure through which a conveyor belt passes. Connected to an inside edge of the tunnel enclosure is a duct that extends upward from the conveyor belt. A blower for this duct either sucks vapor away from the conveyor belt or blows vapor from the enclosure interior toward the belt. Regardless of the flow direction, a vapor curtain forms inside the tunnel enclosure and represents a transitional region from all vapor to all air. Control of the blower for the duct assembly is based on vapor concentrations in the tunnel enclosures adjacent to each port. A microprocessor compares measured concentration levels and alters the blower motor frequency in such a manner as to minimize the difference in concentration levels at each port.

20 Claims, 17 Drawing Sheets

METHOD AND APPARATUS FOR RETENTION OF A REFRIGERANT FLUID IN A REFRIGERATION ENCLOSURE

FIELD OF THE INVENTION

This invention relates to a method and apparatus for improving the overall efficiency of a refrigeration enclosure and, more particularly, to an improved method and apparatus for retaining a refrigerant fluid within the refrigeration enclosure.

BACKGROUND OF THE INVENTION

In operating cryogenic refrigeration equipment, effort must continually be expended to minimize the amount of air that enters the equipment during operation. In such equipment, the refrigerant is a cryogenic fluid that is vaporized during the refrigeration process. Characteristically, air manages to enter the refrigeration enclosure through ports which allow product to pass into and out of the enclosure. Typically, the air is much warmer and contains a considerable amount of moisture relative to the environment inside the enclosure. Moreover, the moist air can be thought of as a contaminant in the sense that it reduces the purity level of the vapor inside the enclosure.

There are a number of reasons to minimize air infiltration: refrigeration efficiency, economics and capacity to recycle the vaporized refrigerant. Refrigeration efficiency is defined as the quantity of heat removed from a product being cooled, compared to the amount of refrigeration being expended by the cryogen. When moist air enters a refrigeration enclosure, it will necessarily be cooled to the current temperature therewithin. Cooling of air instead of product decreases the cooling potential of the refrigerant, and hence decreases refrigeration efficiency. Additionally, freezing of the water vapor can potentially lead to a damaging build-up of ice inside the enclosure. Ice build-up can become severe enough to require a stop in the production line of the product being cooled, to allow for a thawing period. Clearly, the cooling potential of the refrigerant is reduced or lost during this thaw cycle. The net result is a higher cost in operation.

To recycle the refrigerant, the best approach is to start with the purest stream possible from the source, which in this case is a refrigeration enclosure. The economics associated with recycling a refrigerant are greatly impacted by relatively small changes in the purity of the vapor inside the enclosure. Hence, the greatest economic advantage is achieved when air infiltration is minimized.

Minimization of air infiltration is important in both tunnel and spiral refrigerators. Typically, a tunnel refrigeration enclosure has an entrance port to allow product to enter the enclosure, an exit port to allow product to leave the enclosure, and a flat conveyor in-between. A spiral refrigeration enclosure has similar porting, except that the ports are at different heights relative to the base of the refrigeration enclosure. Inside the enclosure, the conveyor follows a spiral or helical pattern between the ports.

U.S. Pat. No. 3,728,869 to Schmidt describes the recycling of cryogenic vapors from an enclosure (primarily a spiral refrigerator). The pressure within the refrigeration enclosure is kept above atmospheric pressure to minimize air and other contaminant infiltration, and pressure and gravitational effects cause a flow thereof from each refrigeration port. The exiting vapor is collected in adjacent vestibules or spillover boxes in such a manner as to form a vapor barrier above the vestibule. Air infiltration is prevented by a vapor dam. Vapor is removed from the bottom of a vestibule by a piping network driven by a blower system. Control of vapor removal is through motorized on/off dampers in the ducting leading away from the vestibules.

U.S. Pat. No. 4,356,707 to Tyree et al., describes several refrigeration enclosure designs which utilize both mechanical and cryogenic refrigeration. A spiral refrigeration enclosure using a cryogenic refrigerant is described wherein diluting chambers are positioned adjacent the refrigeration ports. The concern at a lower port is to minimize outflow of the denser-than-air cryogen vapor from the refrigeration enclosure. A chamber adjacent to the lower port includes several baffles and a blower system operated at a constant frequency. Vapor is retarded from leaving the refrigeration enclosure by sucking a portion of the vapor from a dilution chamber and redirecting it back into the enclosure. The remaining portion of the vapor exits through the refrigeration enclosure opening and dilutes any air trying to enter the enclosure. Side vanes, manually positioned, are used to balance flow across a conveyor belt.

Variable fan speed control has been employed in the prior art as a means to prevent premature spillover of cryogenic vapor from a refrigeration enclosure or to prevent air from entering. In U.S. Pat. Nos. 4,528,819 (Klee) and 4,800,728 (Klee), the concern is how to prevent loss of cryogen vapor from a refrigeration enclosure or air infiltrating into the enclosure. A temperature sensor is used to indicate whether cryogenic vapor is leaving the enclosure or air is entering the enclosure. Coupled to the temperature sensor is a blower system. In U.S. Pat. No. 4,528,819, the blower is on the exhaust line of the refrigeration enclosure. In U.S. Pat. No. 4,800,728, the blower mechanism is internal to the refrigeration enclosure and is part of the circulation system.

Other methods have been employed to minimize the vapor leaving a refrigerator or the surrounding air from contaminating the interior of a refrigeration enclosure. U.S. Pat. No. 4,947,654 (Sink et al.) describes atmosphere control within spiral refrigerators and tunnel refrigerators. For spiral refrigerators, an improvement to the dilution system discussed in U.S. Pat. No. 4,356,707 is disclosed. The blower or blowers of the dilution system are no longer operated at a fixed frequency, but control of the blower system is now coupled to the cryogen injection rate. The primary sensing device can be either a temperature sensor inside the enclosure or a pressure sensor in the liquid supply line that feeds the cryogen injectors. The exit port can have a similar system to prevent air infiltration by letting a small amount of vapor exit through the port. For a tunnel refrigerator, similar means are discussed for minimizing air infiltration and reducing the premature loss of vapor from the refrigerator.

U.S. Pat. No. 4,955,206 (Lang et al.) discusses a variable speed control method for maintaining the environment within a refrigerator. For a tunnel refrigerator, maintenance of the internal environment is enhanced by the addition of a photocell transmitter and receiver sensor system located outside the entrance port and a baffle-linkage scheme surrounding one of the internal axial fans. The sensor system provides control information based upon how much vapor is leaving the refrigerator. If an excessively high level of vapor is escaping, the baffle-linkage system directs flow away from the port. If the opposite is true, the baffle-linkage responds by directing vapor toward the port. In a spiral refrigerator, the dilution blower system is coupled to the photocell sensing system and is not dependent on the injection rate. In both refrigerator configurations, the blower systems have either variable or single speed drives.

Another method for maintaining cryogenic purity inside a refrigeration enclosure is by employing a controlled evacuation system on the enclosure. U.S. Pat. No. 5,186,008 (Appolonia et al.) discusses a method for controlling an amount of vapor extracted from an enclosure as part of a recycle effort. For a spiral refrigeration enclosure, the locations of suction are at an upper vestibule and at the bottom of the refrigeration enclosure. For the bottom suction location, the amount of vapor leaving the enclosure is a constant ratio relative to the injection rate. The remaining portion of vapor resulting from injected cryogen exits through the entrance and exit ports. Sufficient suction needs to be applied at the upper vestibule to minimize gravitational effects on the vapor flow leaving through the lower port and to prevent air infiltration in the upper port. Hence, the pressure in the upper vestibule region is required to be the lowest pressure relative to the refrigeration enclosure and the surrounding atmosphere.

It is an object of this invention to provide an improved apparatus and method for minimizing escape of refrigerant vapor from a refrigeration enclosure and inlet of air into the enclosure.

SUMMARY OF THE INVENTION

The method of the invention is based on the comparison of local vapor concentrations at inlet and outlet refrigerator ports and taking action based on that comparison. Control apparatus incorporating the invention is installed inside a refrigeration enclosure, adjacent to a port, preferably at the lowermost port. If the enclosure contains multiple ports at similar height, then each port has a form of the control apparatus attached to it. The control apparatus adjusts a flow of vapor leaving the interior of the enclosure. The control apparatus includes a duct assembly and a blower system. The bottom portion of the duct assembly is a tunnel enclosure through which a conveyor belt passes. Connected to an inside edge of the tunnel enclosure is a duct that extends upward from the conveyor belt. A blower system for this duct either sucks vapor away from the conveyor belt or blows vapor from the enclosure interior toward the belt. Regardless of the flow direction, a vapor curtain forms inside the tunnel enclosure and represents a transitional region, from all vapor to all air. To assist the formation of the vapor curtain, a further suction duct assembly is connected to the outer edge of the tunnel and spans the conveyor belt. This duct draws the exiting vapor toward the top of the tunnel enclosure. Hence, a major portion of the vapor gets directed back into the refrigeration enclosure while a small amount of vapor leaves the enclosure to prevent air contamination. A gas analyzer is used to measure the vapor concentration level in the tunnel.

Control of the blower for the duct assembly is based on vapor concentrations in the tunnel enclosures adjacent to each port. At regular intervals, the vapor concentration level at each port is measured. A microprocessor compares the measured concentration levels and alters the blower motor frequency in such a manner as to minimize the difference in concentration levels at each port.

In a preferred embodiment a vapor curtain balance is established. By maintaining a vapor curtain balance, a relatively high purity vapor stream can be withdrawn from the enclosure through a third port without affecting the vapor curtain balance of the refrigeration enclosure. Internal blowers within the enclosure can advantageously provide circulation and mixing of the vapor throughout the enclosure to minimize stratification of the vapor and permit removal of a high purity vapor stream from any point within the refrigeration enclosure.

DETAILED DESCRIPTION OF THE INVENTION

Figure 1:
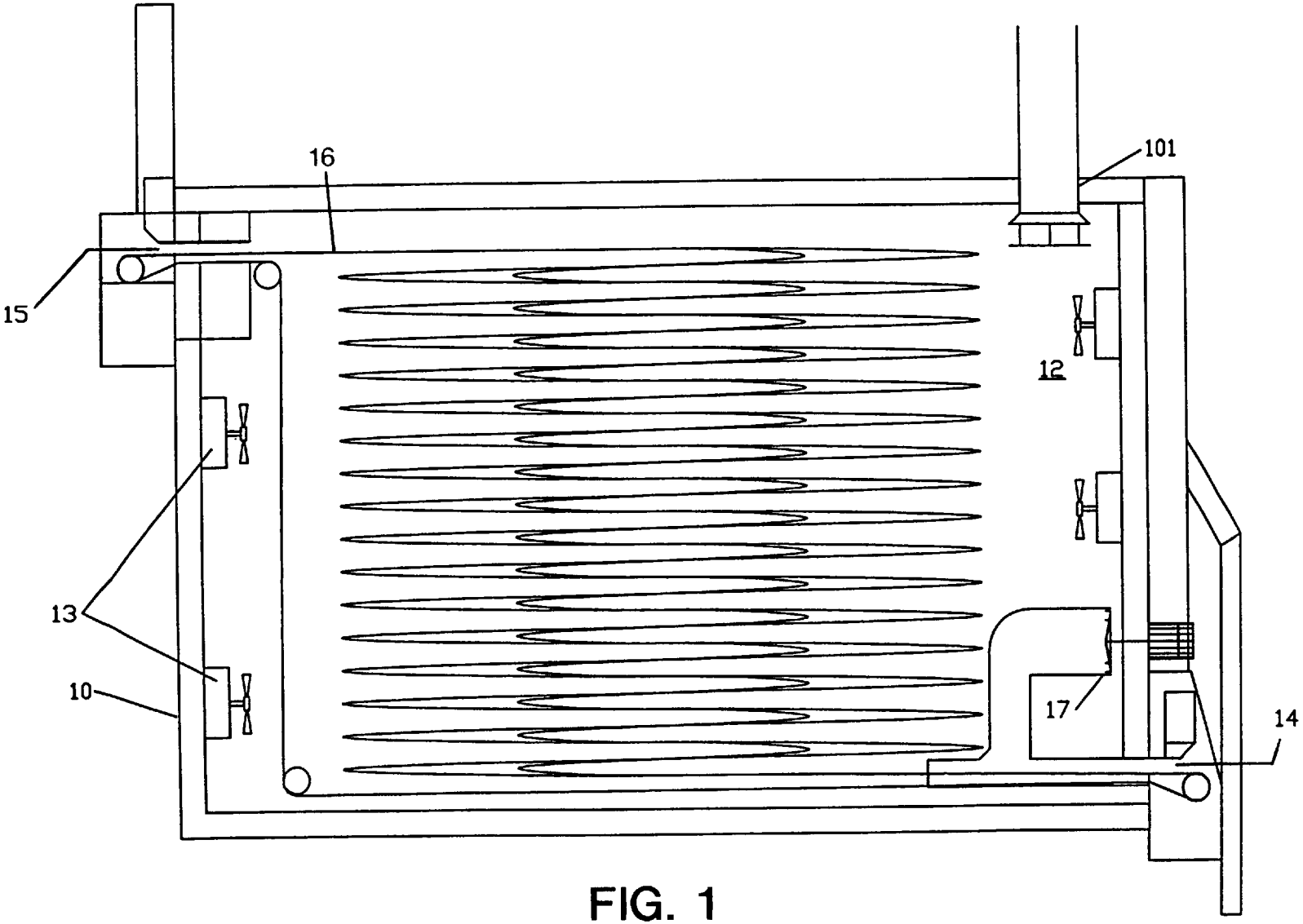
FIG. 1 is a schematic view of a refrigeration enclosure with a spiral conveyor, which refrigeration enclosure incorporates the invention hereof.
Figure 2:
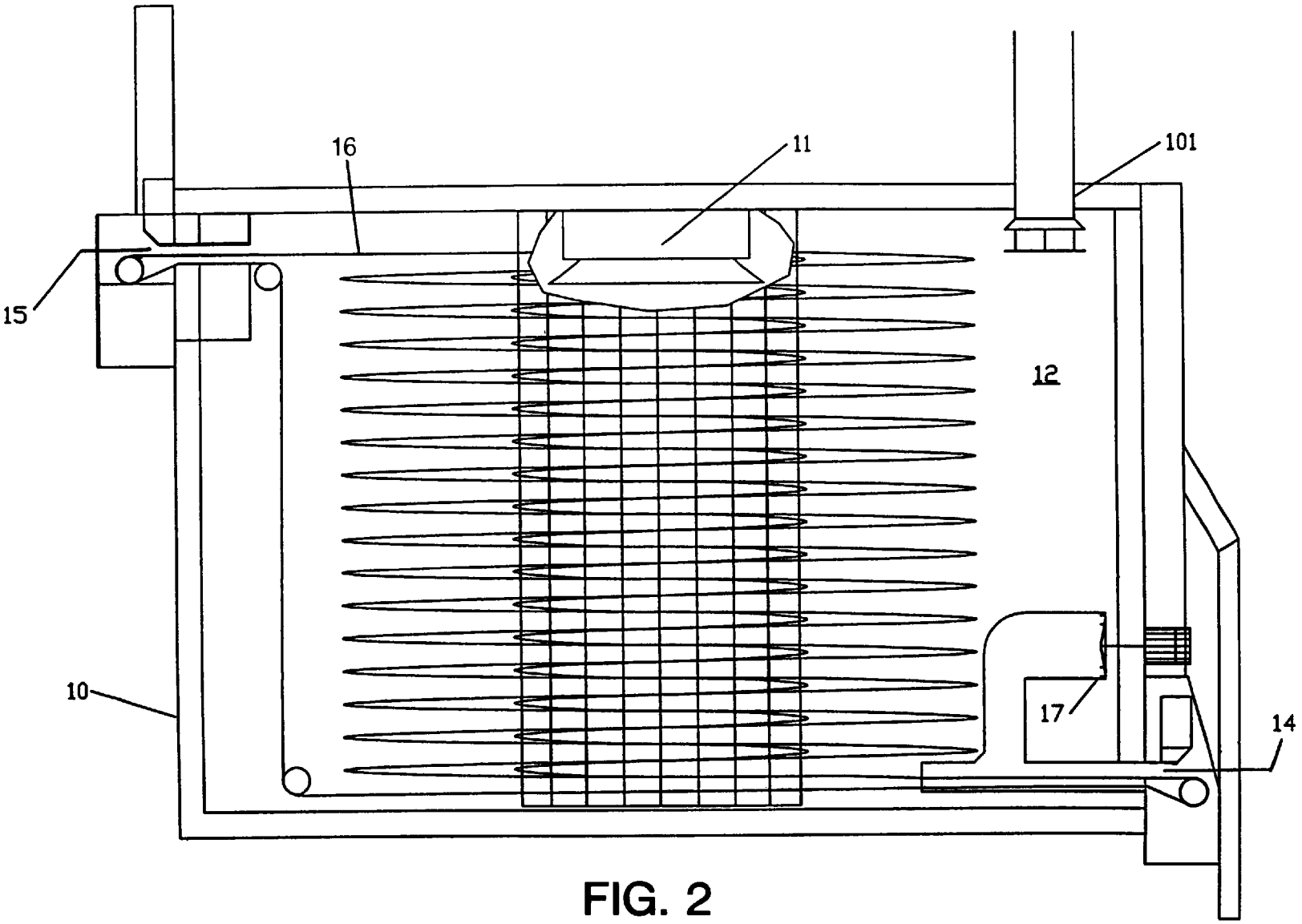
FIG. 2 is a schematic view of a refrigeration enclosure with a spiral conveyor and center cage fan, which refrigeration enclosure incorporates the invention hereof.

Referring to FIG. 1, a refrigeration enclosure includes insulated walls, base, top and an interior volume 12. One or more circulating fans 13 (or a center cage fan 11 as shown in FIG. 2) are positioned about interior volume 12. A conveyor belt 16, having a helical or spiral pattern, transports product through refrigeration enclosure 10. The product to be cooled passes through a lower port 14 and exits refrigeration enclosure 10 through an upper port 15 or vice versa. While the following discussion is specific to a spiral refrigeration enclosure, other refrigeration designs such as a tunnel configuration can utilize the invention.

A set of injectors and associated piping (not shown) deliver a cryogenic fluid (e.g. carbon dioxide, nitrogen, etc.) into the volume 12. The refrigeration control system is temperature based and provides a signal to a modulating valve on the incoming cryogenic feed line to deliver the amount of cryogen fluid necessary to reach a given temperature within the enclosure.

Figure 3:
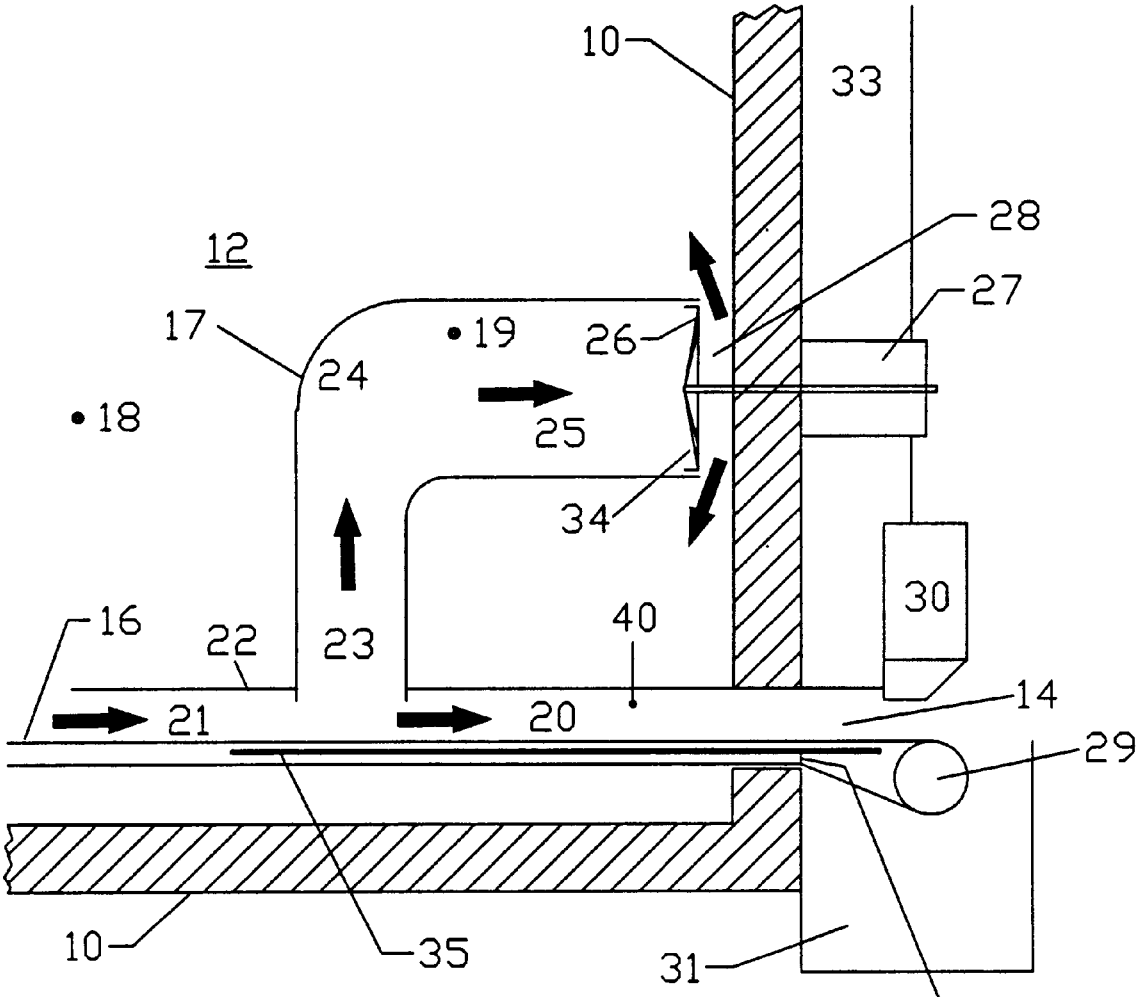
FIGS. 3, 4 and 5 depict a detailed view of a tunnel/ducting arrangement positioned at a first port of the refrigeration enclosure of FIG. 1 with and without exit baffles.

Referring to FIG. 3, refrigeration enclosure 10 includes a duct assembly 17 at inlet port 14. Duct assembly 17 provides a means to suck refrigerant vapor away from conveyor belt 16. Duct assembly 17 spans conveyor belt 16. Inlet port 14 of enclosure 10 couples to a low clearance outer tunnel 20 and an under-the-belt flat plate 35. The upper run of conveyor belt 16 passes over flat plate 35 and through outer tunnel 20 while the lower run of belt 16 does not. Baffle 32 lies between the upper and lower runs of conveyor belt 16 to prevent premature egress of vapor from the enclosure.

Duct assembly 17 opens into interior volume 12 at aperture 21, which is the leading edge of an inner tunnel 22. At the junction of tunnels 20, 22 is a vertical duct 23. The bottom edge of vertical duct 23 has the lowest clearance relative to the conveyor belt. Outer tunnel 20 connects to vertical duct 23 slightly above the bottom edge to establish a small retention cavity along the top of outer tunnel 20. The retention cavity functions to dilute the air that gets into outer tunnel 20 to minimize air contamination reaching the interior of enclosure 10. Under-the-belt plate 35 extends from slightly beyond the enclosure 10 to at least slightly beyond vertical duct 23 so that plate 35 extends to the extreme edge of tunnel 20, and to about the edge of tunnel 22.

The second end of vertical duct 23 attaches to a ninety degree bend 24, which allows a transition in the width of the ducting. Attached to the second end of bend 24 is a horizontal duct 25 which spans belt 16 but is wider than vertical duct 23. Horizontal duct 25 terminates at a plate 34 having dimensions similar to horizontal duct 25. Plate 34 includes openings to accommodate fans 26. It is preferred that two, multiple bladed, center hub blower fans 26 be mounted side by side. Fans 26 are driven by motors 27 externally mounted to refrigeration enclosure 10. The vapor that exits horizontal duct 25 impacts the enclosure wall in region 28 and is dispersed into interior 12. Baffles can be used to direct the vapor flow upwards (relative to horizontal duct 25), downwards, or sideways back into interior volume 12.

As stated above, the present embodiment sucks refrigerant vapor away from conveyor belt 16, as indicated by the arrows in FIG. 3. A small portion of the vapor leaves enclosure 10 through outer tunnel 20, while the major portion of the vapor is redirected into interior volume 12 of enclosure 10. The vapor that escapes through lower port 14 is collected in a spillover box 31. Spillover box 31 is cleared by an exhaust system schematically represented by external vertical duct 33. In this fashion, vapor is exhausted out of the room containing enclosure 10 and away from personnel.

Figure 4:
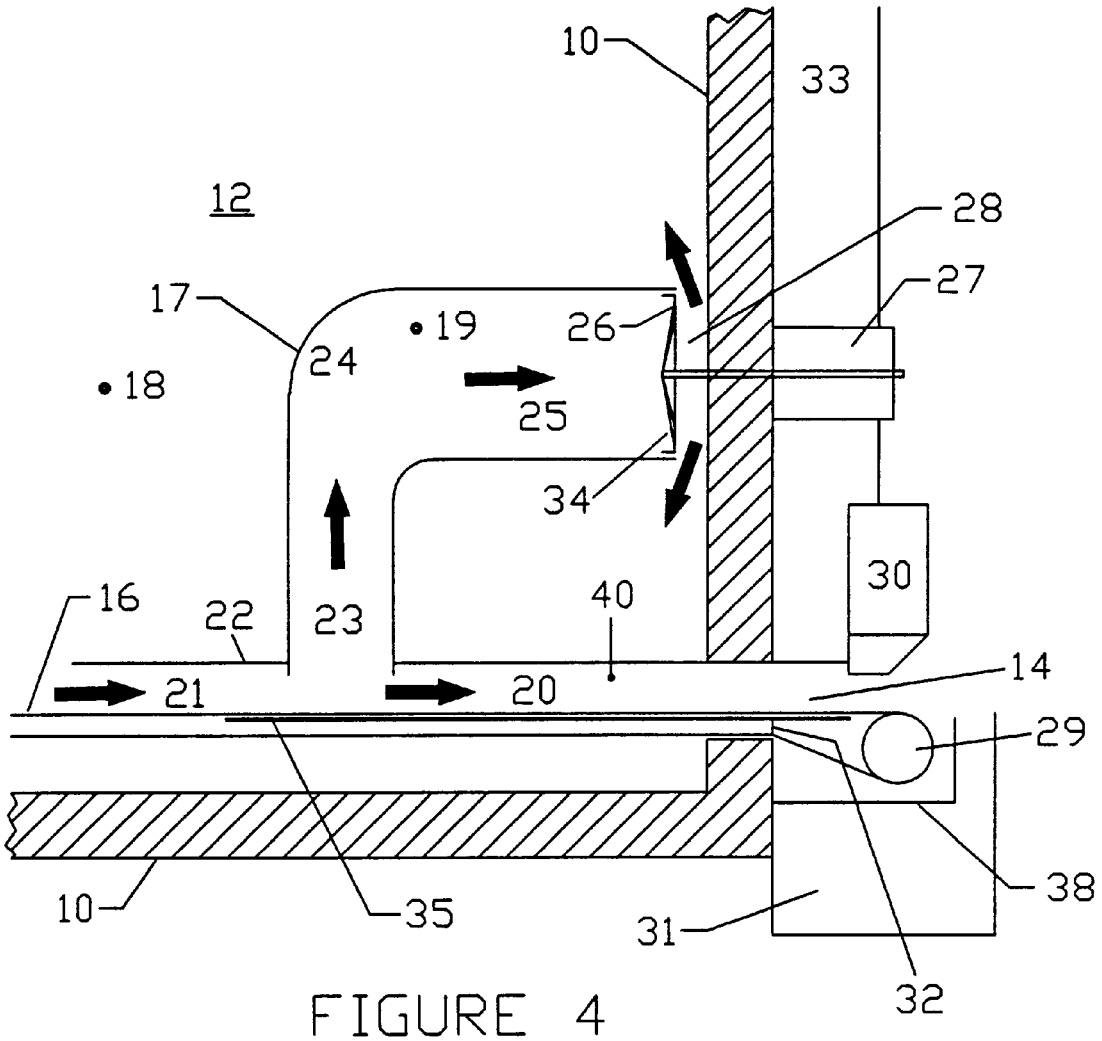

As shown in FIG. 4, it is preferred to locate a spillover baffle 38 within spillover box 31 under the lower run of conveyor belt 16, that extends horizontally from the outside wall of enclosure 10 to slightly beyond conveyor belt roller 29 and then vertically to slightly below the upper run of conveyor belt 16. Spillover baffle 38 collects vapor escaping from inlet port 14 to create a further barrier against the outflow of vapor.

Figure 5:
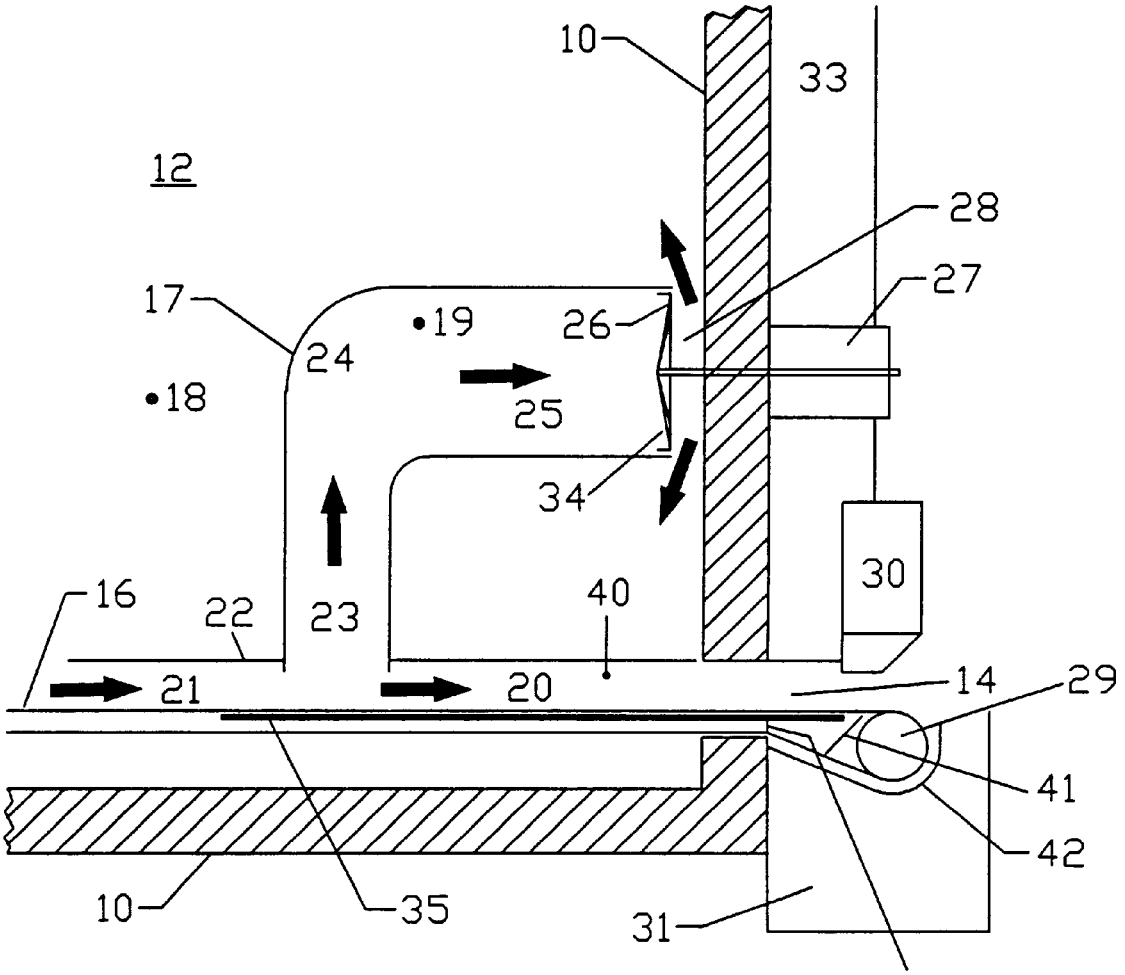

In an alternative embodiment, as shown in FIG. 5, spillover box 31 contains a spillover baffle 42 that extends along the contour of the lower run of conveyor belt 16 and around conveyor belt roller 29 to slightly below the upper run of conveyor belt 16. In this alternative embodiment, a roller baffle 41 is located adjacent to conveyor belt roller 29 in between the upper and lower runs of conveyor belt 16. Roller baffle 41 and spillover baffle 42 create further barriers against the outflow of vapor.

Figure 6:
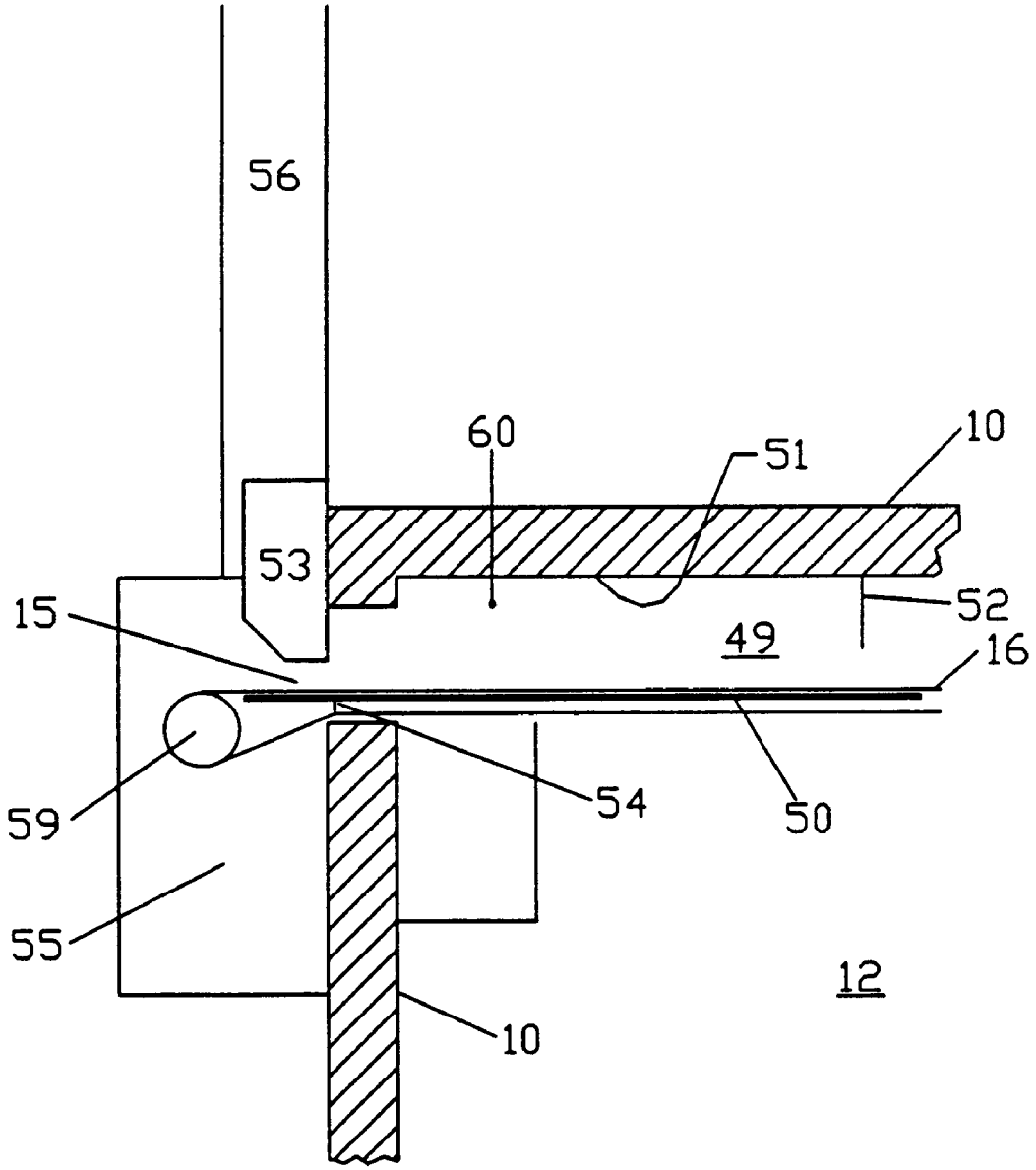
FIGS. 6, 7 and 8 depict a detailed view of a tunnel/ducting arrangement positioned at a second port of the refrigeration enclosure of FIG. 1 with and without exit baffles.

Outlet port 15 of refrigeration enclosure 10 is also locally modified by additional duct work (see FIG. 6). Outlet port 15, like inlet port 14, has a tunnel-shaped enclosure 49 formed by several interconnecting pieces to impede air entering and vapor escaping. An under-the-belt plate 50 begins just forward of conveyor belt roller 59 and extends into refrigeration enclosure 10. Tunnel side pieces (not shown) begin at the edge of the refrigeration wall and extend into the enclosure. The interior edge of under-the-belt plate 50 and the interior edge of the side pieces should form a common edge inside the enclosure 10. Top 51 of tunnel 49 is the refrigeration enclosure ceiling. A vertically positioned baffle 52 that spans conveyor belt 16 is also affixed to refrigeration ceiling 51. The clearance between baffle 52 and conveyor belt 16 is determined by the product being cooled and preferably is adjustable. Baffle 52 should be contained by the sides of tunnel 49, but does not have to be located at the interior edges of the side pieces.

The position of outlet port 15 is determined by the height of over-the-belt pickup unit 53. Like the vertically positioned baffle 52, the clearance of over-the-belt pickup unit 53 off conveyor belt 16 is determined by the product to be cooled. With this tunnel configuration, a retention cavity is formed similar to the one in outer tunnel 20 near lower port 14. Additional baffles 54 are placed between the upper and lower layers of conveyor belt 16 to minimize the inlet of air and the outlet of vapor. A spillover box 55 collects the vapor exiting from outlet port 15 and is exhausted via duct 56.

Figure 7:
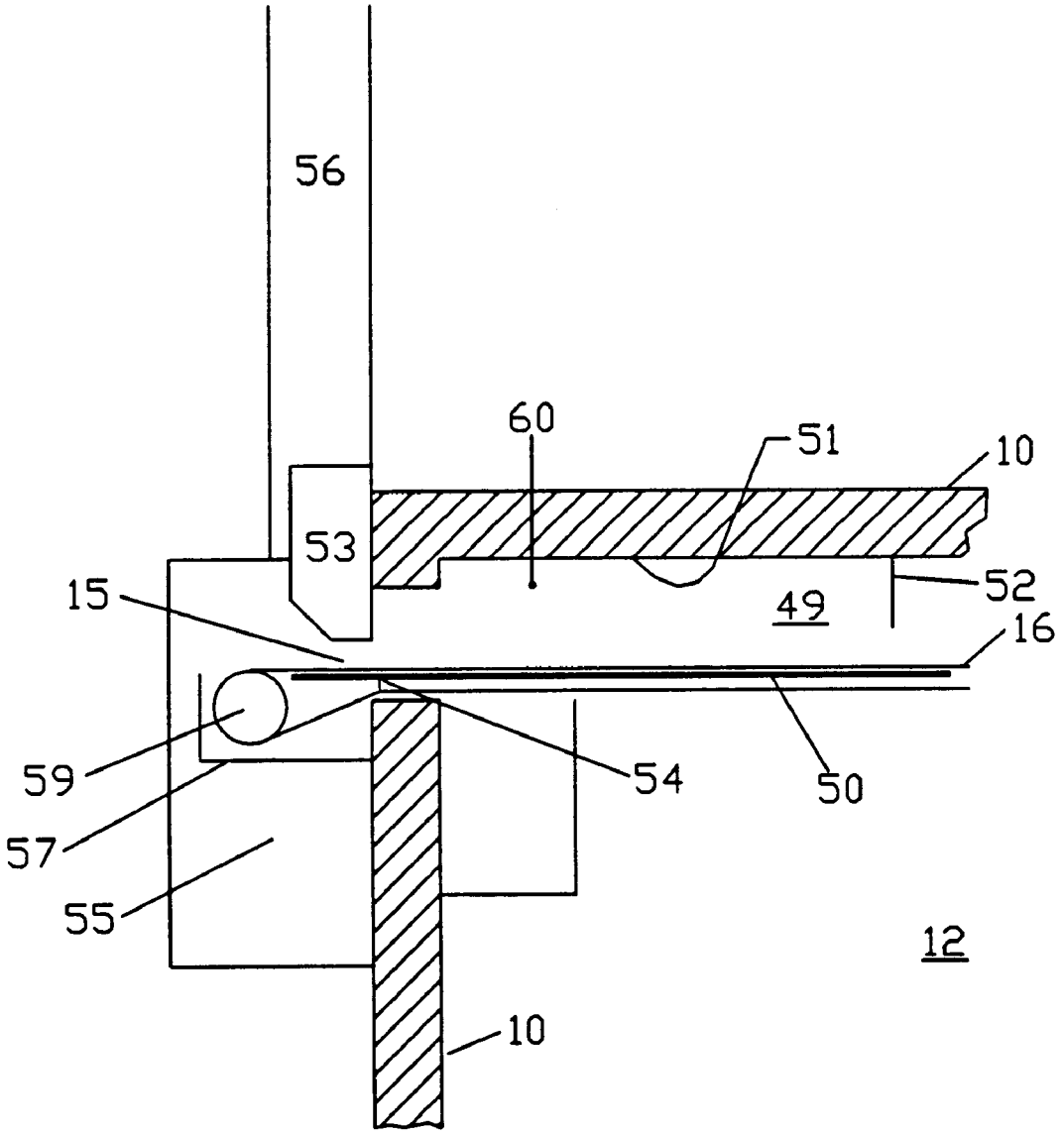

As shown in FIG. 7, at outlet port 15, as with inlet port 14, it is preferred to locate a spillover baffle within the spillover box. A spillover baffle 57 is located within spillover box 55 under the lower run of conveyor belt 16 extending horizontally from the outside wall of enclosure 10 to slightly beyond conveyor belt roller 59 and then vertically to slightly below the upper run of conveyor belt 16. Spillover baffle 57 collects vapor exiting from outlet port 15 creating a further barrier against the outflow of vapor.

Figure 8:
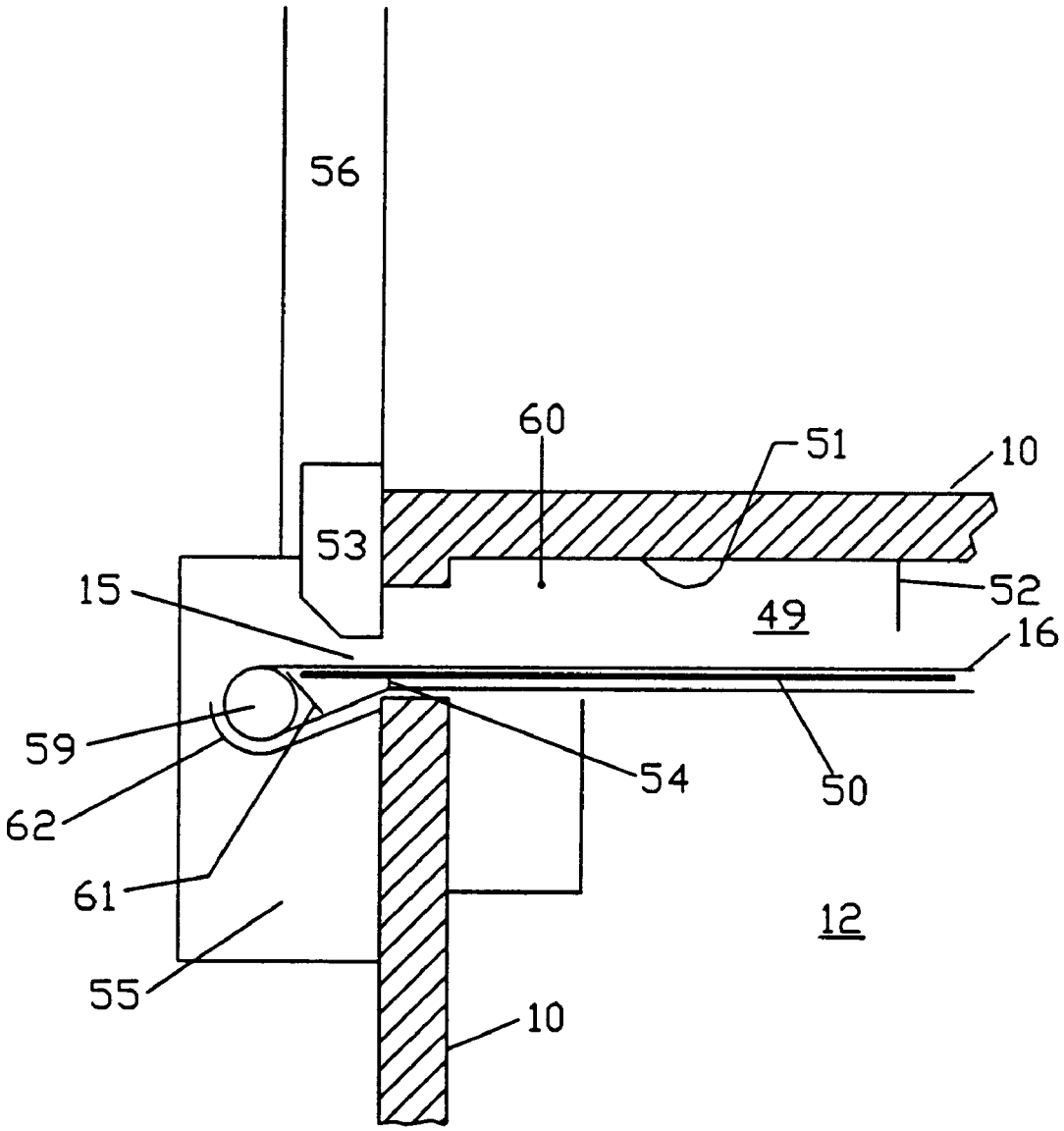

In an alternative embodiment, as shown in FIG. 8, spillover box 55 contains a spillover baffle 62 that extends along the contour of the lower run of conveyor belt 16 and around conveyor belt roller 59 to slightly below the upper run of conveyor belt 16. In this embodiment, a roller baffle 61 is located adjacent to conveyor belt roller 59 in between the upper and lower runs of conveyor belt 16. Roller baffle 61 and spillover baffle 62 create further barriers against the outflow of vapor.

It is preferred that both ports (14 and 15) have an over-the-belt pick-up unit (30 and 53). Each over-the-belt pickup unit (30 and 53) has a positive seal to adjacent tunnels (20 and 49) as depicted in FIGS. 3 and 6. Suction for over-the-belt pickup unit (30 and 53) is provided by the exhaust system, here shown as external ducts 33 and 56. The function of this pickup unit is two-fold. First, it minimizes the amount of air that enters into a tunnel. Second, it tends to cause any exiting cryogenic vapor to raise off of conveyor belt 16 and combats the effect of gravity on the vapor. By keeping the vapor level as high as possible in a tunnel, any air that enters a tunnel is diluted. In addition, an over-the-belt pickup unit has been found to minimize vapor stratification inside a tunnel.

A control procedure for refrigeration enclosure 10 is based on monitoring vapor concentrations near each of ports 14 and 15. The sensing system includes gas analyzers to monitor the vapor concentration in each tunnel configuration. Therefore, outer tunnel 20 has a sensor port 40 and upper tunnel 49 has a sensor port 60. In general, the preferred sensor location is inboard from the leading edge of the over-the-belt pickup units 30 and 53. The control procedure is based on the difference in cryogenic gas concentrations between the two tunnels. For comparison purposes, it is preferred to use a single analyzer for monitoring both locations. Therefore, an appropriate network of pipe/tubing, automatically controlled valves and a timing device are required (not shown).

Figure 9:
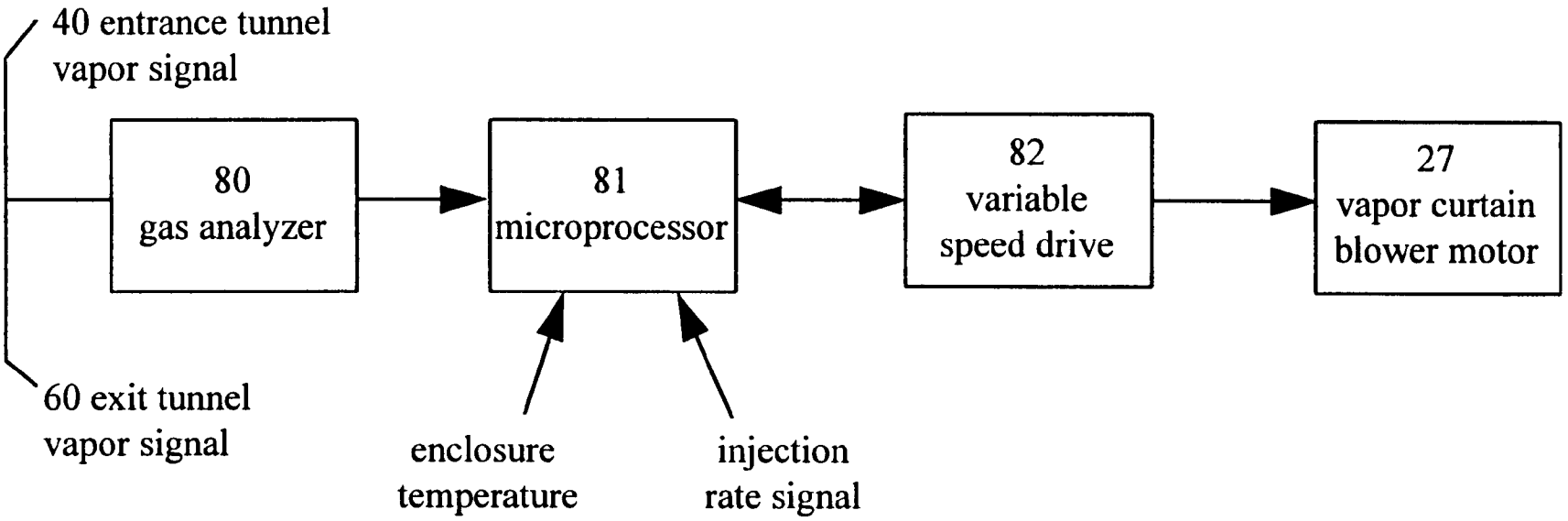
FIG. 9 is a schematic block diagram of control apparatus for the invention incorporated in the refrigeration enclosure of FIG. 1.

FIG. 9 illustrates a microprocessor 81 which provides a means to control the timing of the valves as required to obtain acceptable readings from each location using gas analyzer 80. An algorithm based primarily on the difference in concentrations in each tunnel provides a frequency setting signal to variable speed drive 82, which drives fan motors 27. The algorithm optimizes frequency control to the extent that a minimum is achieved in the difference in concentrations. A predetermined setpoint pattern is not used. Essentially, the correction to the frequency of variable speed drive 82 is based on the magnitude of the difference in concentrations. The larger the difference, the greater the correction to the frequency level.

The algorithm essentially has two modes: a near steady state condition or non-steady state. For near steady state conditions, the control algorithm is an endless loop that does the following: collects vapor concentration samples from each tunnel following a predetermined time interval, compares the samples collected, and corrects fan frequency based on the difference in the samples. For non-steady state conditions, such as during a cool down of refrigeration enclosure 10, the fan frequency is corrected as a function of the rate of change of the injection rate and/or the rate of change of the refrigeration enclosure temperature.

Duct assembly 17, as adjusted by the control system, establishes a vapor curtain in outer tunnel 20. The term vapor curtain is defined here to mean a vapor front where transition occurs from all vapor (concentration level of interior volume 12) to all air. The thickness of this front is not critical, except that it needs to be contained in outer tunnel 20. If the front resides outside port 14, then blower motors 27 are not rotating fast enough. If no vapor front forms in tunnel 20, then the motors 27 are rotating too fast.

The key to maintaining a high purity level inside enclosure 10 is the establishment of a vapor curtain or front in outer tunnel 20. This is only successful if the upper outlet port 15 and the lower inlet port 14 are in gaseous communication with each other. When a vapor curtain forms in tunnel 20, a vapor front is also formed in tunnel 49.

Extraction of Vapor Stream for Recycling

The present invention permits withdrawal of a high purity vapor stream, assuming a vapor curtain balance system is in place and operating. Within refrigeration enclosure 10, the internal blower system (fan units 13 or center cage fan unit 11), provides a well mixed environment. Since a thoroughly mixed environment is contained within the enclosure 10, a high purity vapor stream can be withdrawn from interior volume 12 anywhere on or within enclosure 10. Accordingly, the high purity vapor stream may be withdrawn from any location including, for example, at or near an exterior wall of enclosure 10, at or near ports 14 or 15, and at or near the center of interior volume 12. Such a high purity vapor stream may be removed as a controlled exhaust, and then liquefied and reintroduced into enclosure 10.

Figure 10:
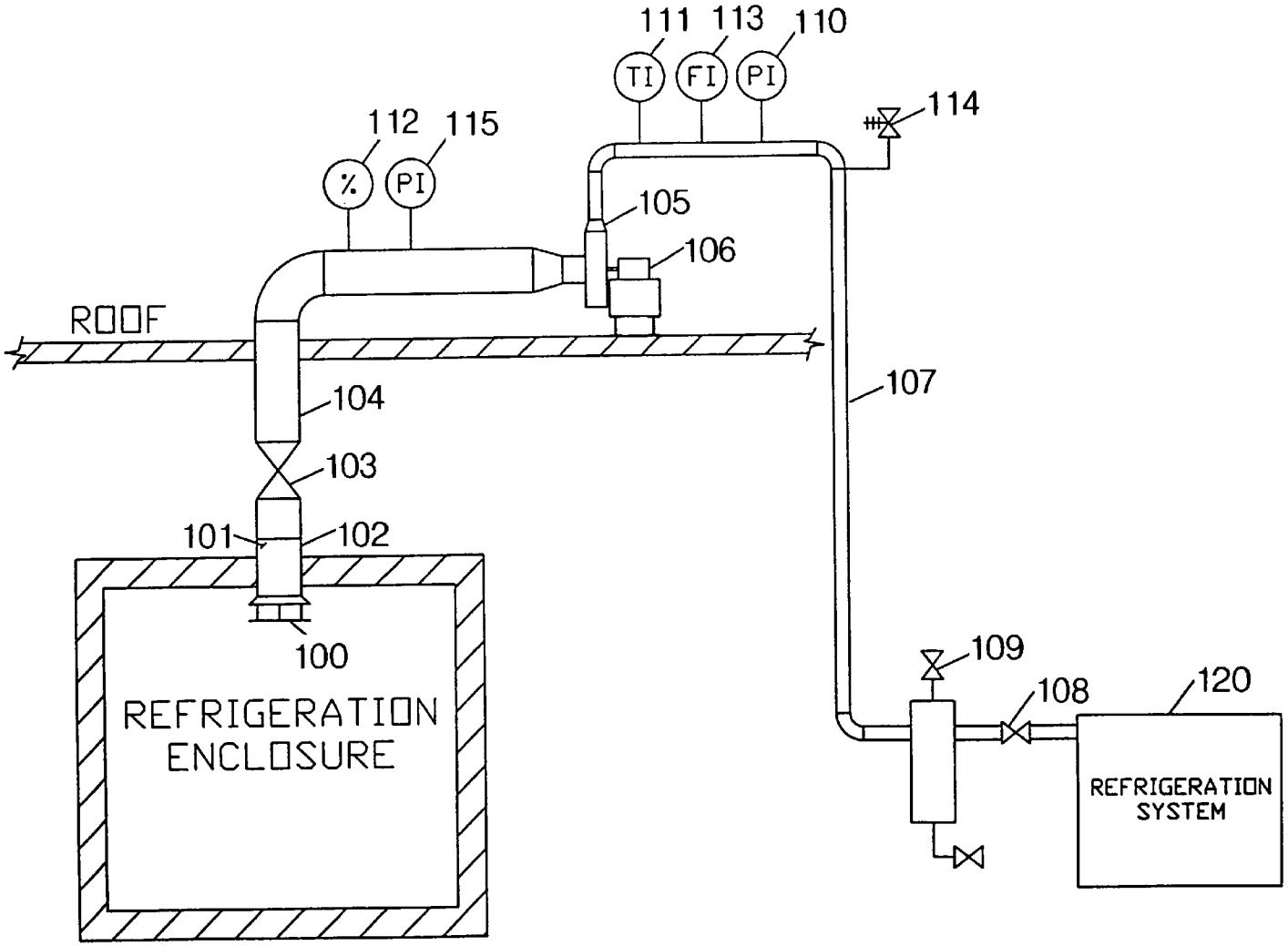
FIG. 10 is a schematic illustration of exhaust ducting from a refrigeration enclosure to a refrigeration unit, wherein the exhaust ducting is controlled to maintain a desired refrigerant concentration in the refrigeration enclosure and the ducting.

Referring to FIG. 10, a withdrawal port 101 includes ducting 102 that is sealed to the insulated ceiling of enclosure 10. A plate 100 is located below the lower end of duct 102 to protect the duct during cleaning of the enclosure. The opposite end of duct 102 is connected to an isolation valve 103. Additional ducting 104 is connected to the opposite end of isolation valve 103. The downstream end of duct 104 connects to a blower housing 105, which is driven by a motor 106.

The duct assembly extending from withdrawal port 101 to blower housing 105 will contain a vapor having a subatmospheric pressure and therefore, proper sealing of the ductwork is required. Connected to the outlet of blower housing 105 is additional ducting 107 which terminates at an isolation valve 108. Beyond isolation valve 108 is a refrigeration system 120 to liquefy the vapor stream for recycling purposes.

Ducting 107 downstream of blower housing 105 contains a number of devices including a static pressure sensing location 110, a temperature indicator 111, a gas flow metering device 113, and a modulating valve 109. Modulating valve 109 is required to permit, when necessary, a portion or all of the vapor stream to be diverted away from refrigeration system 120. Static pressures are used to monitor the operational characteristics of blower housing 105 (via readings from pressure sensor 115 in ductwork 104 upstream of blower housing 105 and from pressure sensor 110 in ductwork 107 downstream of blower housing 105). Upstream of blower housing 105 is a gas analyzer 112.

Extraction of vapor from enclosure 10 is precisely controlled and is dependent on the control system for the vapor curtain balance system. Like the control procedure for the vapor curtain, control of the extraction of a vapor stream (recovery line blower motor frequency) from enclosure 10 is based on a comparison in gas concentrations inside the tunnels (20 and 49) and vapor stream in the recovery line ductwork 104. The tunnel concentration value can be either an average value of the monitored concentrations at each sensor (40 and 60) or a single measurement taken at either sensor.

The underlying principal of the control procedure is to maintain the highest concentrations in the recovery line, and, secondarily, to maximize the flow of extracted vapor without collapsing the vapor fronts that are established in the tunnels. Testing has shown that control of the recovery line blower motor frequency can be achieved with considerable difference in the concentration values, on the order of 10 percent to 50 percent. Hence, the control procedure monitors the concentrations and maintains the difference between the concentrations within a predetermined maximum offset value. The correction to the blower frequency is based on the magnitude of the difference in concentrations and how close the maximum offset value is being satisfied. A decrease in a tunnel gas concentration will obviously occur before the recovery line concentration decreases. Furthermore, a significant reduction in the injection rate is used to indicate that the concentration level in enclosure 10 is expected to decrease.

There are three control modes (see FIG. 10). Mode one has first isolation valve 103 on the recovery line closed. This condition is the same as if the recovery line was not attached to the enclosure. The recovery line control system is essentially idle.

Figure 11:
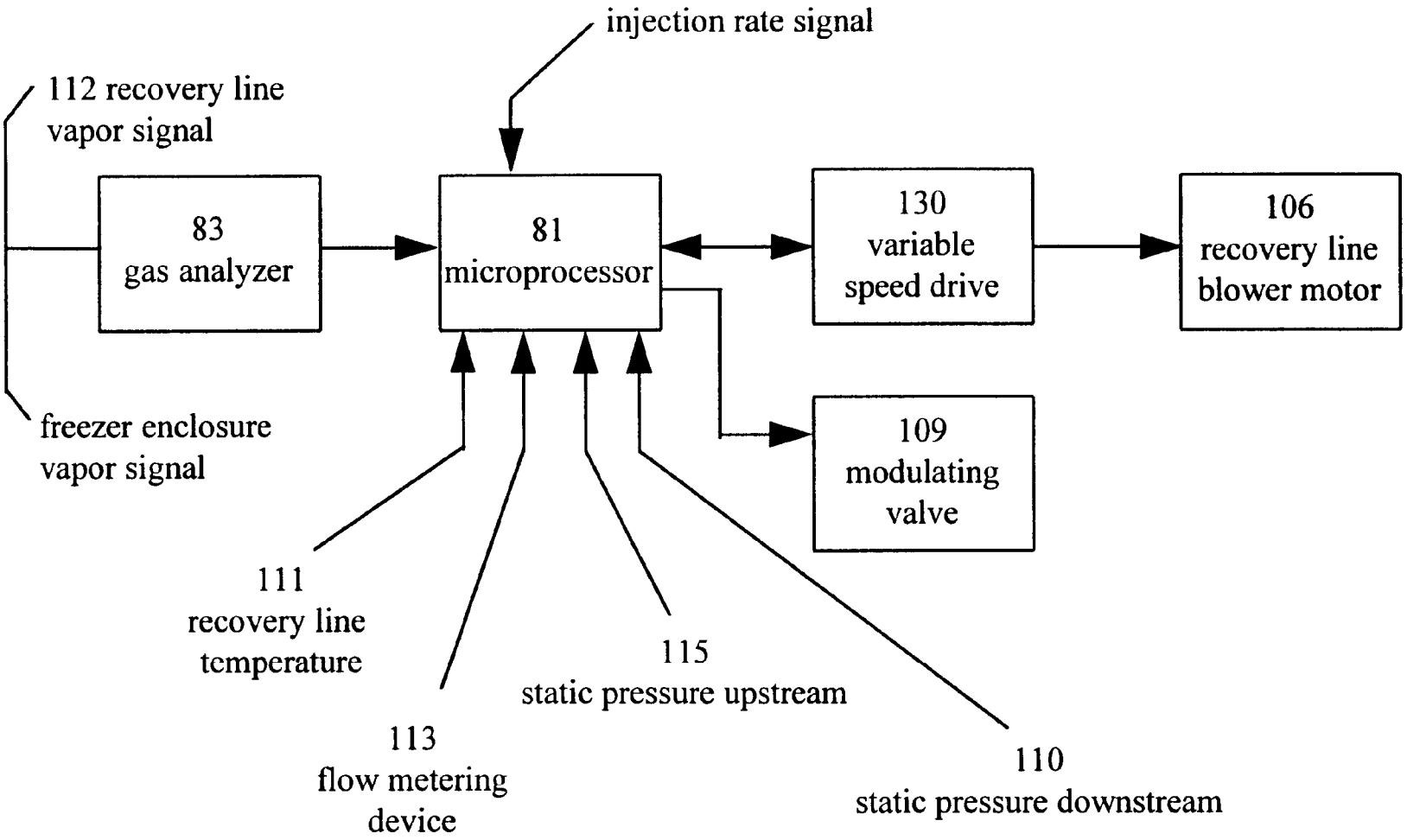
FIG. 11 is a schematic block diagram of control apparatus for the exhaust ducting from the refrigeration enclosure of FIG. 10.

All sensors 110, 111, 112, 113 and 115 on the recovery line are monitored by microprocessor 81 (See FIG. 11). Microprocessor 81 provides control signals to modulating valve 109 and to variable speed drive 130, which operates the blower motor 106 at the correct frequency.

Mode two has first isolation valve 103 open, but second isolation valve 108 closed. In this mode, the recovery line behaves like an exhaust line, as all vapor leaving through withdrawal port 101 exits the recovery line through modulating valve 109. This condition will occur if there is a sudden problem with refrigeration system 120. By quickly redirecting the flow, impact on the environment of interior volume 12 is kept to a minimum.

Mode three, the typical mode of operation, occurs when both isolation valves 103 and 108 are open. In this mode, vapor is withdrawn from enclosure 10 and is sent to refrigeration system 120. Again, the objective of the control procedure is to maximize the vapor concentration level in the recovery line.

The recovery line control procedure is dependent on the vapor curtain control procedure. When the recovery line is operational, the vapor balance curtain scheme essentially balances the refrigeration to provide a fixed loss of vapor out of refrigeration enclosure ports 14 and 15. The remaining portion of vapor exits enclosure 10 through the recovery line. If the extraction rate from enclosure 10 is too great, the vapor balance system indicates an upset by an increase in air infiltration since too much vapor is being removed. If the extraction rate is too low, the recovery line system is not optimized and flow through blower housing 105 needs to be increased. If the flow in the recovery line meets the capacity of the refrigeration system, refrigeration system 120 is maximized and any excess vapor flows through ports 14 and 15 providing additional support to the vapor curtains.

Tunnel Refrigeration Enclosure Configuration

A tunnel refrigeration enclosure operates in a similar manner to a spiral refrigeration enclosure to maintain the interior environment at high vapor concentrations. The main difference is that tunnel enclosure ports are typically at the same height relative to the base of the refrigeration enclosure. As a result, gravitational effects are not as prevalent in a tunnel refrigeration enclosure as they are in a spiral arrangement. The present invention controls the inlet of air into the tunnel refrigeration enclosure by allowing at least a small portion of vapor to leave each tunnel port.

Figure 12:
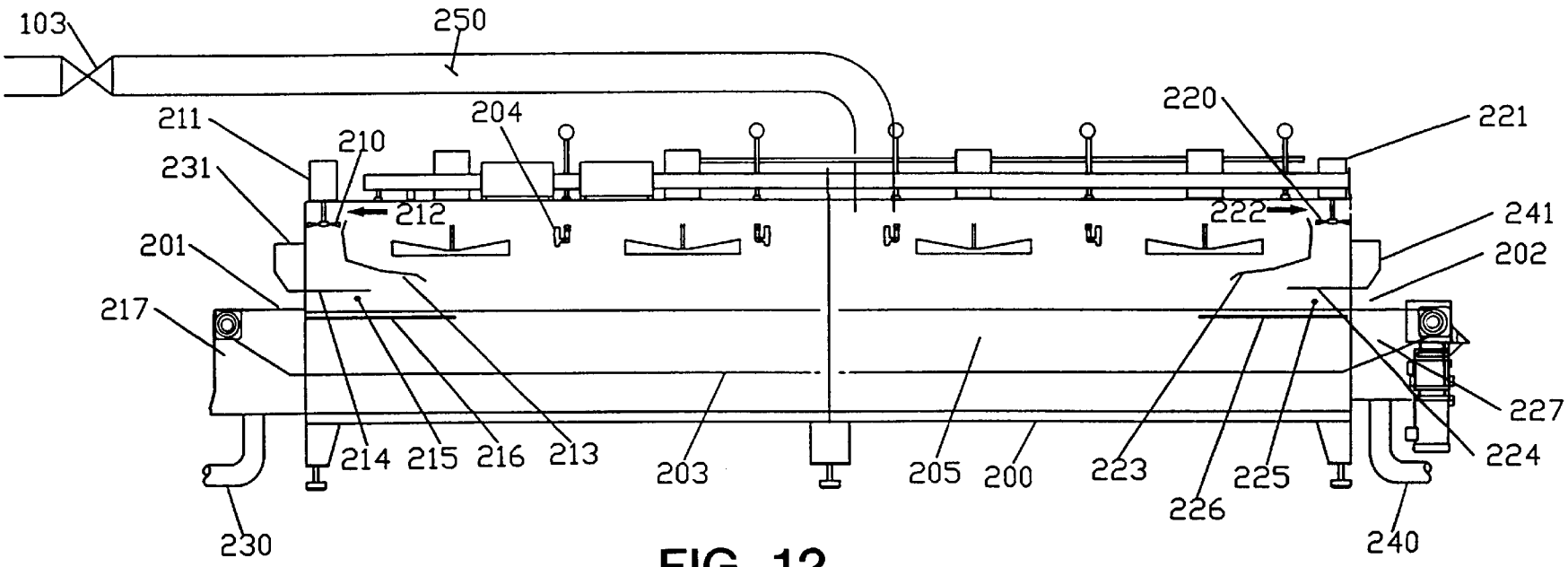
FIG. 12 is a schematic view of a tunnel refrigeration enclosure which incorporates the invention hereof.

A tunnel refrigeration enclosure 200 is shown in FIG. 12. For exemplary purposes, product enters enclosure 200 through port 201 and exits the refrigeration enclosure through port 202. Product is transported through enclosure 200 on a conveyor belt 203. A cryogenic fluid enters the refrigeration enclosure via an injection system 204. The amount of cryogen being delivered inside enclosure 200 is based on a temperature control method in conjunction with a modulating valve on the injection line and is known to those skilled in the art.

Additional ducting and blower systems are provided adjacent to each refrigeration port to control and minimize air infiltration into the refrigeration enclosure and uncontrolled outlet of vapor from enclosure 200. The principle involved is similar to the method employed for the spiral refrigeration enclosure described above. At inlet port 201, a ductwork configuration and multiple fans 210, each driven by its own motor 211 are positioned. Vapor is directed as shown by arrow 212. Vapor is drawn into duct assembly 213, which has at least one bend. Duct assembly 213 can have multiple bends, and must span the width of conveyor belt 203. The bottom portion of duct assembly 213 directs this vapor to impact upon vapor trying to leave enclosure 200 through the enclosure port. A vapor to air front forms in tunnel enclosure 214 or just beyond the tunnel.

Tunnel enclosure 214 rests on a base plate 216 to control how the vapor exits the port. At the leading edge of tunnel 214 is an over-the-belt pickup unit 231 which aids in minimizing air infiltration. The pickup unit 231 is of similar design to the unit 30 used on the spiral enclosure. Vapor exiting from inlet port 201 is collected in a spillover box 217 and is exhausted via duct 230. A gas sensor 215 is used to monitor vapor concentration inside tunnel 214. Gas sensor 215 is preferably located on the inside of the leading edge of over-the-belt pickup unit 231.

A similar configuration is required at outlet port 202. Adjacent to opening 202 are positioned ductwork and multiple fans 220, each driven by its own motor 221. Vapor is directed as shown by arrow 222. Vapor is drawn into duct assembly 223, which has at least one bend. Duct assembly 223 can have multiple bends, and spans the width of conveyor belt 203. The bottom portion of duct assembly 223 directs this vapor to impact upon vapor trying to leave enclosure 200 through outlet port 202. As with port 201, transition tunnel 224 rests on a base plate 226 to control how the vapor exits the port. A gas sensor 225 is used to monitor vapor concentration inside tunnel 224. At the edge of tunnel 224 is an over-the-belt pickup unit 241. The vapor exiting from outlet port 202 is collected in spillover box 227 and is exhausted via duct 240.

Figure 13:
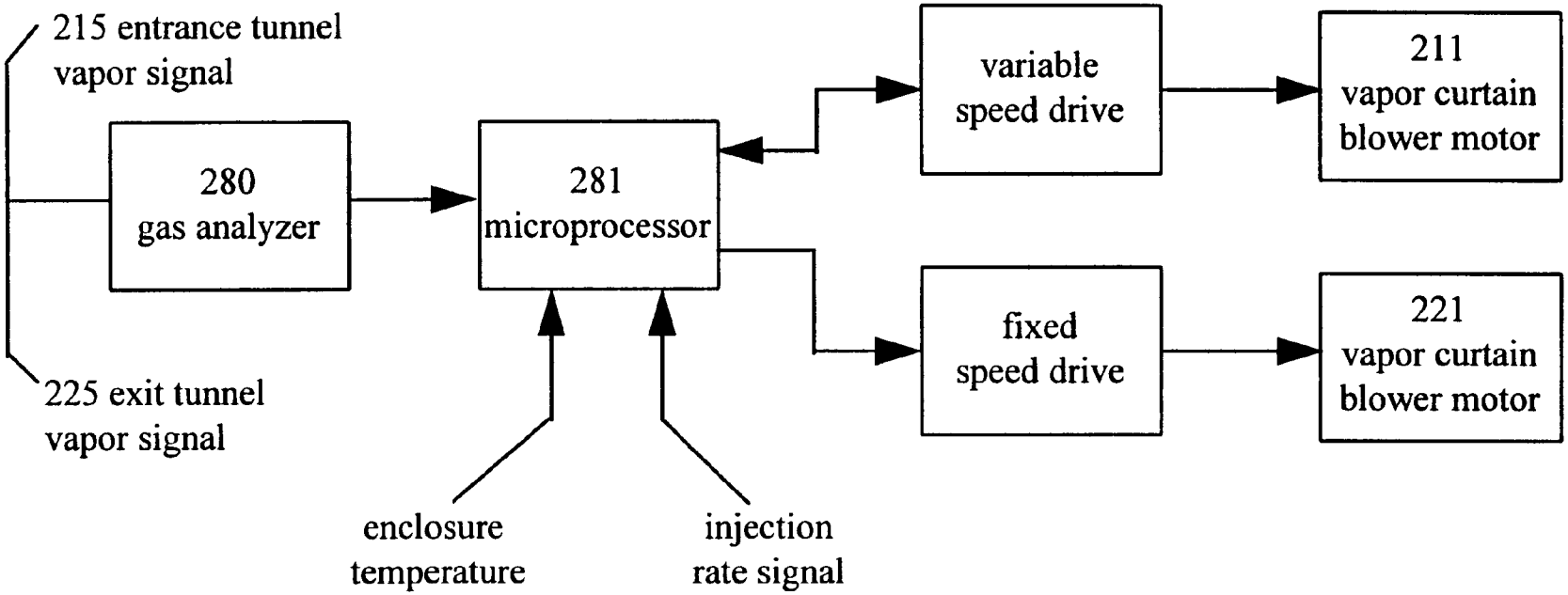
FIG. 13 is a schematic block diagram of control apparatus for the invention incorporated in the tunnel refrigeration enclosure of FIG. 12.

As mentioned above, vapor concentration is monitored in each tunnel, 214 and 224. A microprocessor-based device 281 (see FIG. 13) provides a means to control timing of valves of a piping network (not shown) to obtain acceptable readings from each location, using a single gas analyzer 280. The control algorithm is based on the difference in concentrations in each tunnel as discussed above with respect to the spiral refrigeration enclosure. The difference in tunnel concentrations is to be minimized to maximize the concentration inside enclosure 200. Since both tunnel ports 201 and 202 include a duct apparatus, one blower system is operated at a fixed frequency while a second blower system has a controlled variable frequency. The fixed frequency blower system simulates the gravity head that naturally occurs in a spiral refrigeration enclosure. By measuring the difference in the port concentrations 215 and 225, the variable speed blower is adjusted accordingly.

For example, consider port 201 with a variable speed blower system 211 and port 202 with the fixed frequency blower system 221. If sensor 215 reads a higher concentration relative to sensor 225, the frequency of the blower will be increased. If sensor 215 reads a lower concentration relative to sensor 225, the frequency of the blower will be decreased. The size of the correction to the variable speed blower system is based on the magnitude of the difference in concentrations. The larger the difference, the greater the correction to the blower motor frequency.

Like the spiral enclosure vapor balance control method, the tunnel enclosure algorithm essentially has two modes. For near steady state conditions, the control algorithm is an endless loop that does the following: collects vapor concentration samples from each tunnel following a predetermined time interval, compares the samples collected, and corrects blower frequency based on the difference in the samples. For non-steady state conditions, such as during a cool down of enclosure 200, the blower frequency is corrected as a function of the rate of change of the injection rate and/or the rate of change of the refrigeration enclosure temperature.

The extraction of vapor from enclosure 200 for recycling purposes is similar to the method used with a spiral refrigeration enclosure. The key objective, as with the spiral enclosure, is to maintain high purity levels within the enclosure. Hence, both vapor curtains need to be operational to successfully extract a high purity vapor stream from enclosure 200. The withdrawal port for recovery line 250 can be located anywhere on enclosure 200, with the top or bottom surface of enclosure 200 being preferred. The operation of the recovery line system discussed earlier for spiral enclosures is identical for tunnel refrigeration enclosures. On FIG. 12, this scheme has been designated by isolation valve 103, corresponding to the initial valve of the recovery line system as shown in FIG. 10.

A number of alternative configurations may be employed to meet the objective to minimize air infiltration and uncontrolled outlet of vapor. The following embodiments pertain primarily to spiral refrigeration enclosures, but can also be incorporated into other enclosures, such as tunnels. The discussion initially considers alternative designs for ductwork 17 adjacent to input port 14. Alternative duct geometries and control methods are then presented, followed by alternatives for the extraction of a vapor stream from an enclosure.

A major objective of duct assembly 17 is to establish a uniform vapor flow pattern across the width of conveyor belt 16. Primarily, the means to develop a vapor curtain requires the use of axial fans, in which the vapor flows through the blades in a direction parallel to the shaft axis of the fan motor. However, axial fans induce considerable swirl into the flow entering, passing through, and exiting duct assembly 17. Straightening vanes, baffles, and curvature or shape of the duct can minimize the swirl effect on the flow along the conveyor belt in outer tunnel 20 adjacent to port 14.

A centrally placed baffle was inserted into horizontal duct 25 (see FIG. 3) to minimize the upstream effects of the axial fans when implementing the suction method. The baffle extended from top to bottom of duct 25 and split the duct into two smaller rectangular ducts. Testing with and without the baffle indicated that its effect on the flow was marginal, but certainly did not produce a negative effect. A horizontal baffle spanning the duct and placed at the shaft height was also investigated. Like the vertical baffle, the effect on the flow in outer tunnel 20 was minimal. Similar baffling can be inserted into vertical duct 23. Again, the purpose is to disrupt the large-scale vortical flow pattern observed to form in the duct assembly. Two or more vanes can be placed inside vertical duct 23 to act as flow straighteners. Also, baffling, parallel to the conveyor belt path, in vertical duct 23 has been used as blockage to impede vapor pickup off the conveyor belt in an attempt to tune specific flow regions inside outer tunnel 20 to achieve a balanced flow. However, cost considerations and cleaning issues were strong enough factors to render the baffle solution less preferred.

Figure 14:
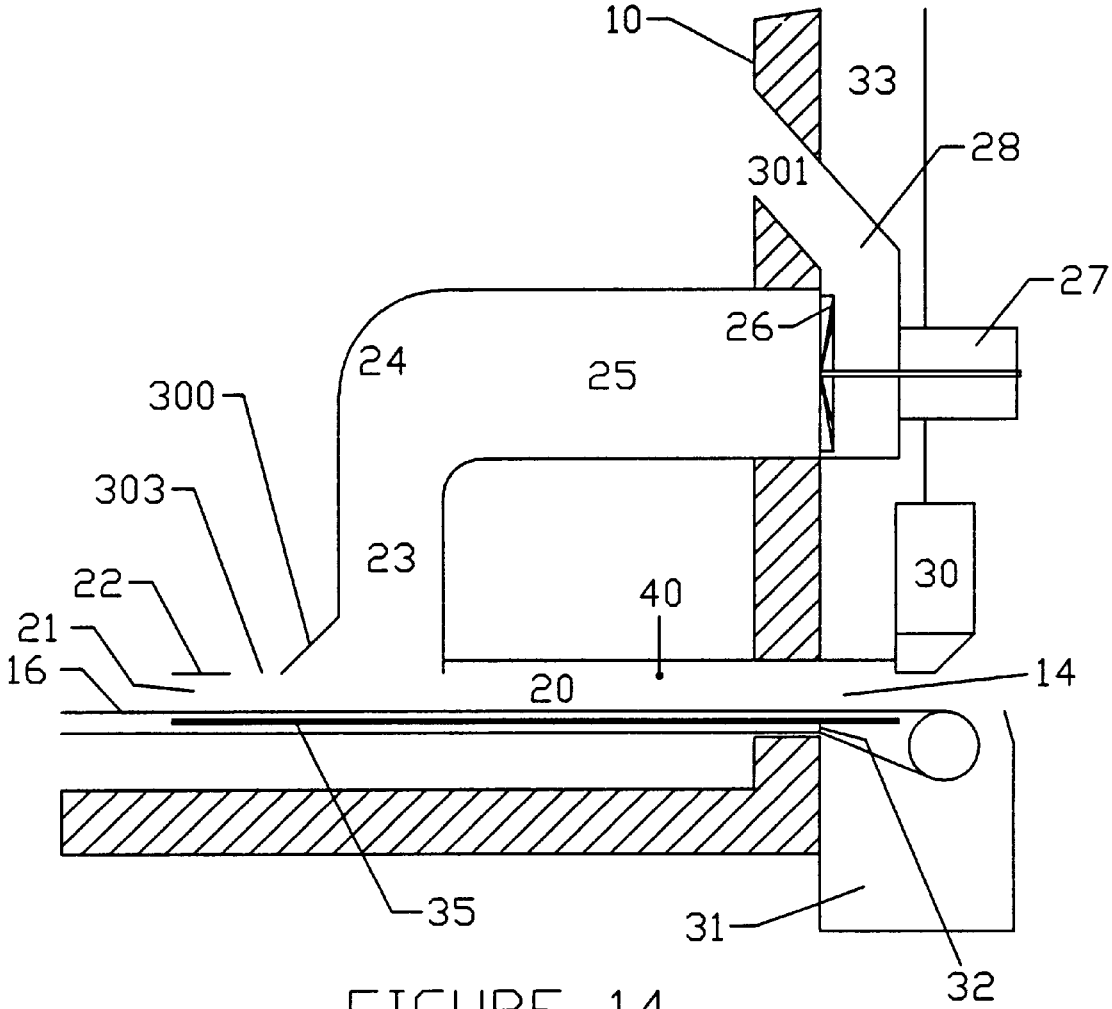
FIG. 14 is a detailed view of a modified tunnel/ducting arrangement for the spiral refrigeration enclosure of FIG. 1.

While preferred embodiments are shown in FIGS. 3, 4 and 5, an alternative design to achieve lift off suction is shown in FIG. 14. The primary difference between the two designs is the duct configuration at inlet feed 21 and the flow coming from fan outlet 28. By comparing FIG. 3 and FIG. 14, the design of FIG. 14 has an angular baffle 300 replacing inner tunnel 22 and part of vertical duct 23. Note, inner tunnel 22 has been moved further into enclosure 10 along the conveyor belt pathway and remains the leading edge of the inlet to the duct assembly. A gap 303 exists between the trailing edge of inner tunnel 22 and the leading edge of angular baffle 300. In addition, the under-the-belt plate 35 has been extended to yield a common edge with inner tunnel 22. Also, gap 303 exists only in the horizontal plane parallel to the conveyor belt path. The side wall height of inner tunnel 22 has been extended to join the side wall defined by the termination of angular baffle 300.

Using the geometry of FIG. 14, inner tunnel 22 acts as a conditioning tunnel for the vapor trying to leave the enclosure along conveyor belt 16. The vapor that is sucked up the ductwork leaves the fan region through ducting 301 and is directed to interior volume 12 of enclosure 10. When the combination of under-the-belt plate 35, conditioning tunnel 22, and gap 303 are not present, performance degrades and control of the vapor leaving the enclosure is poor. A variation of this configuration is that angular baffle 300 may contain ports with covers that can be adjusted to allow different suction patterns to develop. The ports may or may not be equally spaced across the span of the conveyor belt and are used to balance the flow in outer tunnel 20. Linkage can be connected to the ports to provide manual or motorized adjustment, without requiring access to the interior of the enclosure.

For duct assembly 17, the preferred configuration includes two fans and two motors for a spiral refrigeration enclosure. The fans are axial and have a multiple bladed pattern and a large center hub. For some duct geometries, the preferred blade style is centrifugal. However, due to a centrifugal fan becoming unbalanced when icing occurs on the blades, axial fans are used for this invention. For two fans mounted side by side, there is a preferred rotational direction for each fan when employing the suction method. There are three possible configurations for two fans: both fans rotating in opposite directions with the common flow region upward between the two fans, two fans rotating in opposite directions with the common flow region downward between the two fans, and both fans rotating in the same direction. This last configuration is the most preferred.

In addition to testing with multiple bladed fans, testing was completed with one larger two bladed fan. The associated duct work was modified to handle the larger opening required and is shown schematically in FIG. 15. When using a single two bladed fan to develop suction inside the duct, testing revealed that limitations due to the duct/shaft geometry produced an inward flow along the motor shaft originating at the discharge of the fan. This adverse flow condition was minimized by installing a circular disk on the motor shaft to inhibit inward flow. A single, two bladed fan would be expected to be an acceptable alternative to the two fan approach when utilizing the preferred duct geometry.

Figure 15:
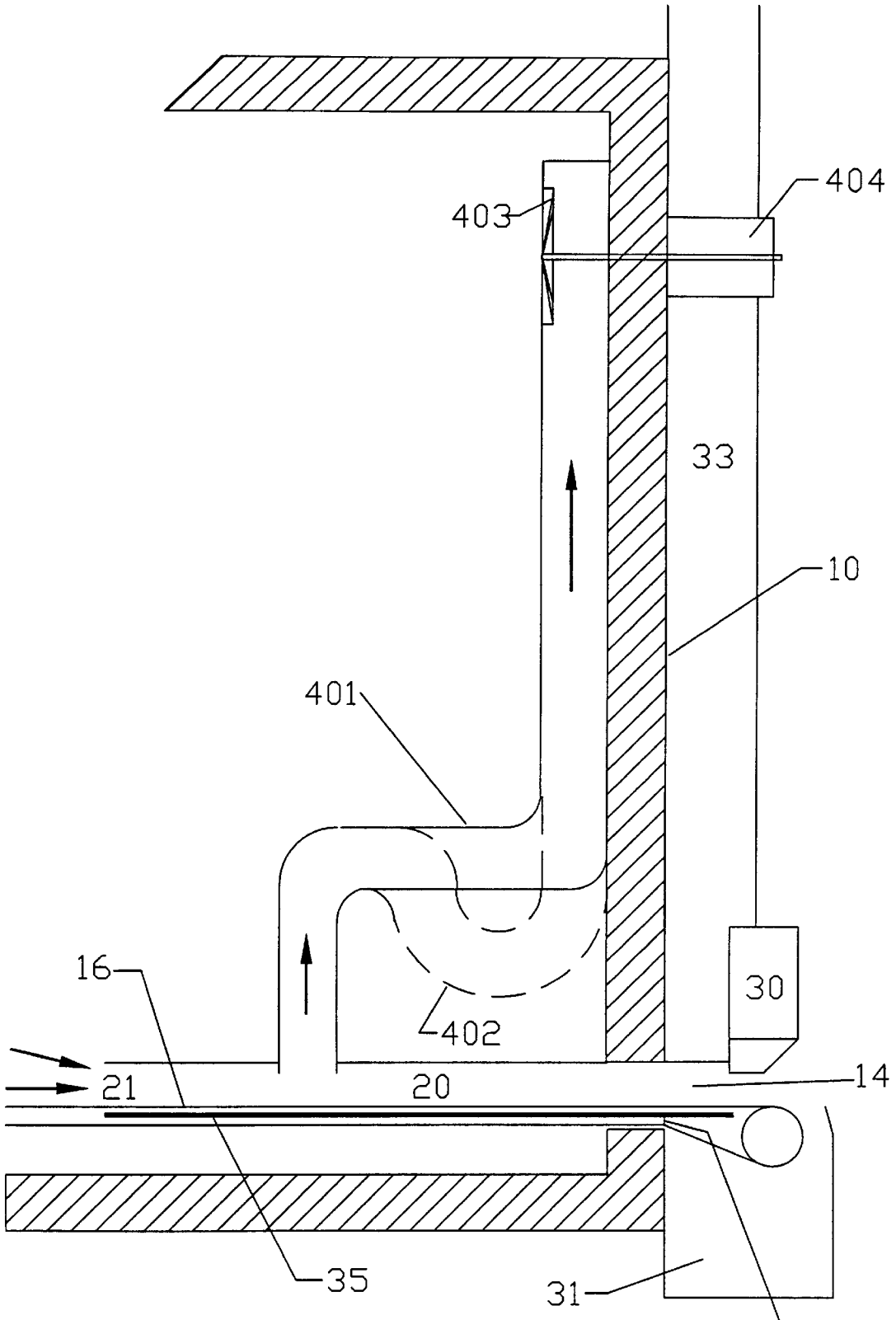
FIG. 15 is a schematic view of a first alternative embodiment of a tunnel/ducting arrangement at a refrigeration enclosure port.

To achieve a balanced flow in the outer tunnel 20 along the conveyor belt, other duct shapes were investigated where the duct geometry was designed to smooth out the vapor flow inside outer tunnel 20. One viable alternative is to have the duct contained within the enclosure. Two variations of internal ductwork were investigated and are shown in FIG. 15. As in the preferred design, vapor is sucked away from the conveyor belt through duct 401 and discharged at fan 403. In one variation, as shown by the solid lines in FIG. 15, the flow is turned twice in duct 401 in an effort to smooth out the vapor flow adjacent to conveyor belt 16. A second variation, as shown by the dashed lines in FIG. 15, turns the flow in duct variation 402 three times to reduce the swirl effect. The advantage to increasing the number of bends is to achieve greater reduction in the swirl effects produced by the fan. However, the greater the number of bends, the higher the horsepower that is required to move an equivalent amount of vapor.

Figure 16:
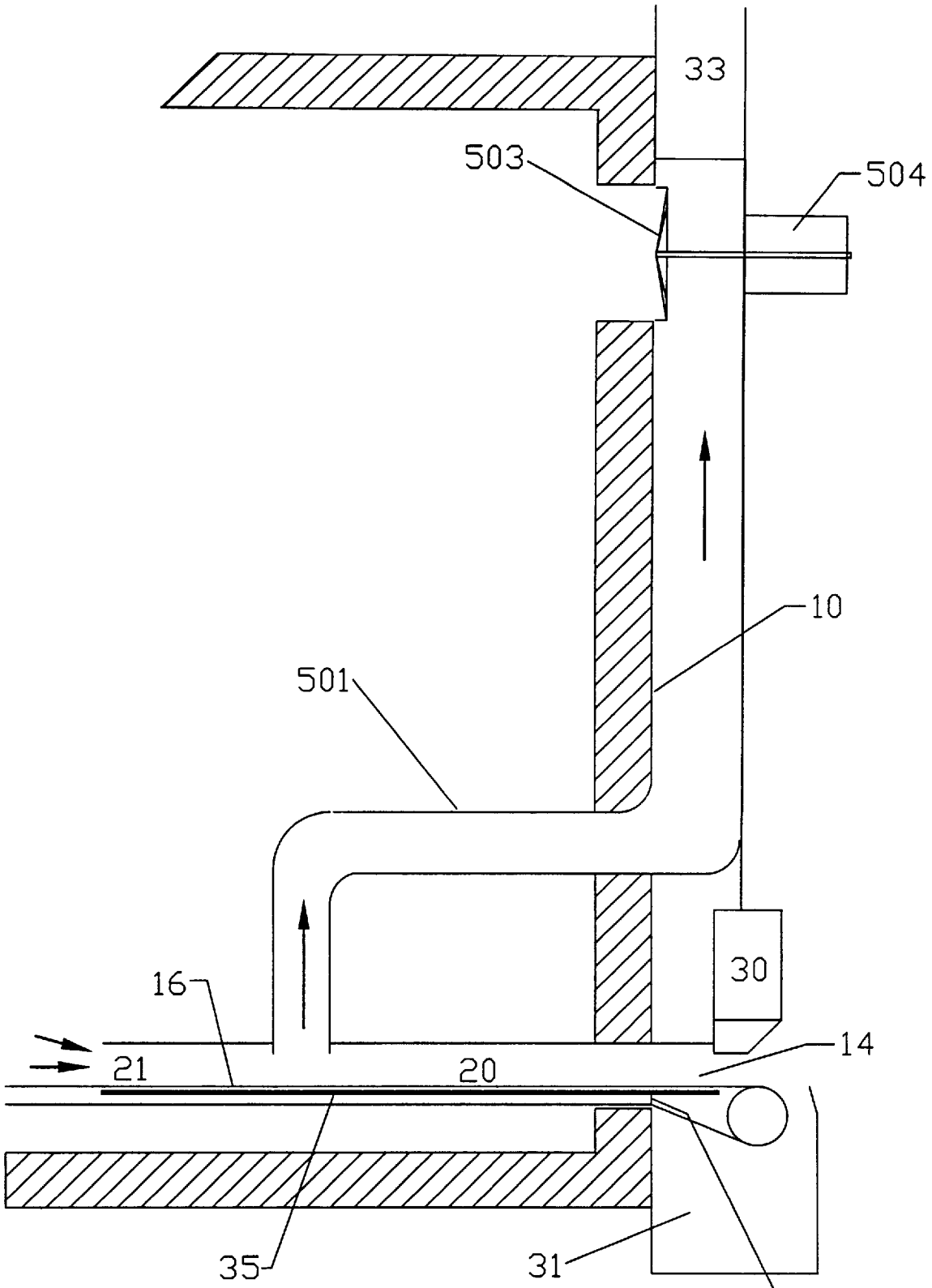
FIG. 16 is a schematic view of a second alternative embodiment of a tunnel/ducting arrangement at a refrigeration enclosure port.

The major disadvantage with an internal duct design as depicted in FIG. 15 involves cleaning and an ability to verify the duct integrity prior to cooling refrigeration enclosure 10 on a consistent basis. As shown in FIG. 16, the cleaning issues can be readily addressed by installing a major portion of duct assembly 501 external to the enclosure. Basically, duct 501 functions the same way as the one shown in FIG. 15. While cleaning concerns are reduced, the external portion of the duct presents different issues. First, the wall of the duct needs to be insulated or refrigeration efficiency of the enclosure decreases. In addition, duct 501 can potentially be on the suction side of the fan and the susceptibility to air infiltration increases. The motors are positioned most favorably when they are closest to the conveyor belt. On the other hand, the duct assembly has to be of sufficient height to minimize the swirl effect from the fan(s) on the flow inside tunnel 20.

Figure 17:
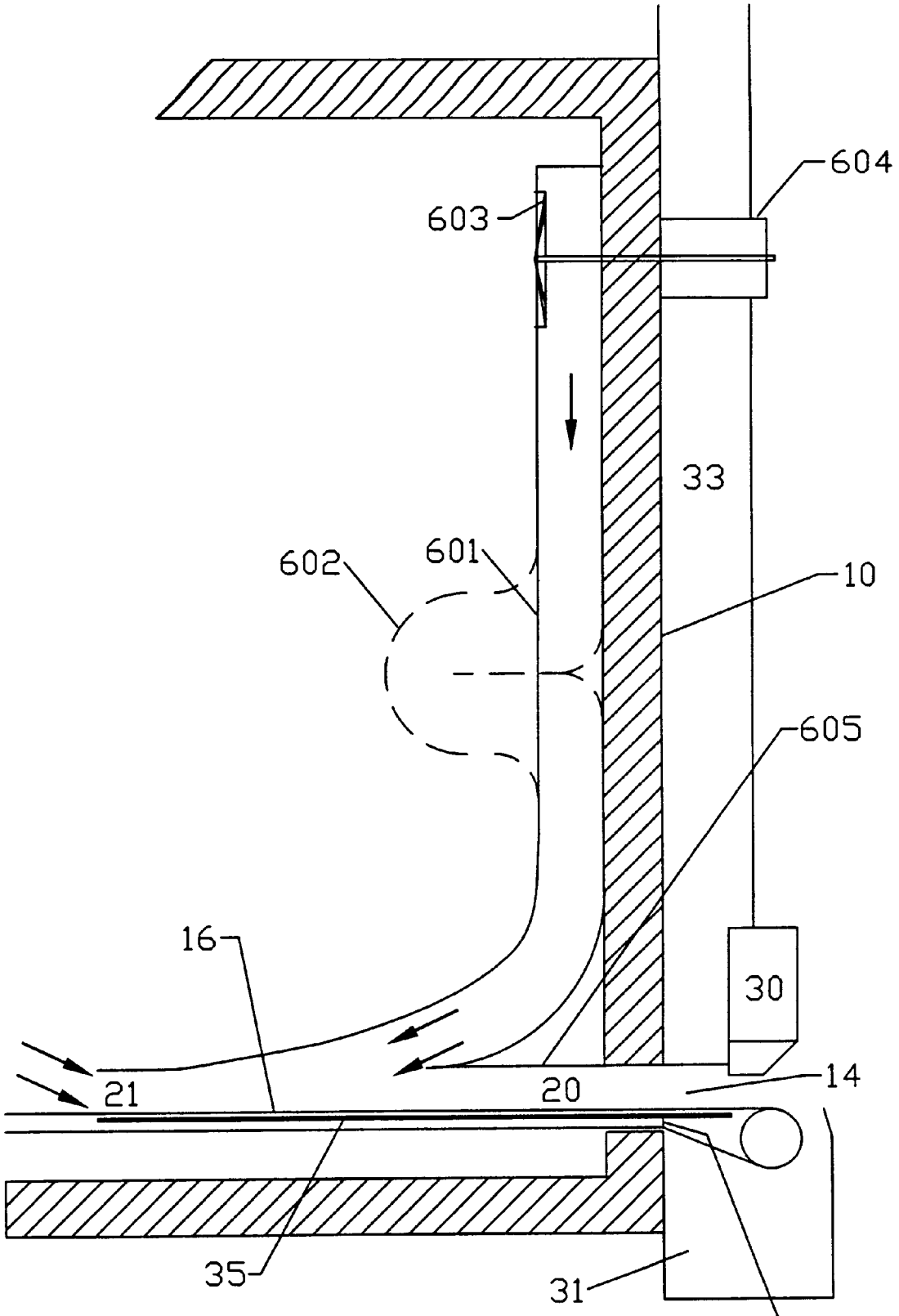
FIG. 17 is a schematic view of a third alternative embodiment of a tunnel/ducting arrangement at a refrigeration enclosure port.

A further embodiment of the invention blows vapor along the conveyor belt as opposed to sucking vapor away from the conveyor belt, as previously discussed. With reference to FIG. 17, two possible duct geometries are shown. The key to making the method successful is to push sufficient vapor down duct 601 to block the vapor trying to exit through lower port 14 due to gravitational effects. As with the suction method, multiple bends in duct 602 are preferred to minimize swirl in the flow adjacent to conveyor belt 16. At the base of the duct assembly, a flat adjustable plate 605 forms the top of outer tunnel 20. An important parameter appears to be the extent of insertion of flat plate 605. In addition, at aperture 21, the height of the upper leading edge of duct 601 (602) from the conveyor below also influences the development of the vapor curtain. Observations made during testing of blowing vapor along the conveyor belt indicated that this method is less efficient than the suction method in a spiral refrigeration enclosure. However, tests completed with a model of configuration 601 revealed that control of the fan motor frequency can be derived from a pressure sensor as well as a gas analyzer.

The preferred control method is a self regulating system based on the difference in concentration in the tunnels that are adjacent to each of the refrigeration enclosure ports. The placement of the gas monitoring device needs to be a sufficient distance away from a port to prevent periodic room air currents from influencing control of the vapor curtain balance system.

Besides using vapor concentrations for control information, other possible control parameters can be used. In particular, pressure sensors can be used to give an indication of how well the vapor curtain is forming. Pressure control is based upon static pressure within the refrigeration enclosure compared against a setpoint pressure. The setpoint is empirically established for a given temperature within the enclosure. Blower speed is adjusted as necessary to maintain the desired setpoint pressure for the selected enclosure temperature. When pressure control is used, it is preferred that measurements of static pressure are made in two locations and a differential pressure is calculated for comparison with the setpoint pressure. Static pressure measurements are made at or near the vapor curtain. Referring to FIG. 3, static pressure is preferably measured in duct 17 at locations 18 and 19.

This invention also permits the vapor curtain to be manually controlled by an operator. The operator becomes equivalent to the microprocessor and takes action based upon reading the difference in vapor concentrations measured in each tunnel. An experienced operator can set the controls for the vapor curtain based on visual indicators inside the tunnels, such as streamers or vapor cloud (formed by condensing moisture of the infiltrating air meeting the exiting vapor stream inside the outer tunnel). The operator will adjust the frequency signal of a variable speed drive, which is connected to the blower motors. The disadvantage of manual control is that an operator is required whenever the enclosure is running.

Control of the vapor being removed from the enclosure is also automatically controlled based on maximizing the vapor concentration in the recovery line and the enclosure. However, alternate indicators can also be used. For example, the flow rate inside the recovery line can be measured and used to control the frequency drive for the recovery line blower system based on a fixed loss of vapor through the refrigeration ports. In addition, differential static pressure can be used as an indication of how well the blower is operating. The advantage in using pressure measurement is that the reading is static and is therefore, less susceptible to freezing. The frequency drive for the recovery line blower system can also be operated in a manual mode. As with vapor curtain manual control, the operator will base decisions on the indicator method being utilized to sense and control the flow activity inside the recovery line.

An alternative control method to achieve high vapor concentrations in tunnel configuration 200 (see FIG. 12) is as follows. First, duct assemblies 213 and 223 are modified from the shape shown in FIG. 12 by adding additional curvature to the duct assembly. For this case, the vapor to air front forms in outer tunnels 214 and 224. The second change is to replace the fixed frequency blower system with a controlled, variable frequency drive system. Now, both blower systems are controlled by microprocessor 281. However, the frequency of blower systems 211 and 221 may or may not be running at the same frequency.

For this system, control is based principally on an overpressure-like condition in enclosure 200 due to the vaporizing liquid refrigerant, rather than maintaining a difference in concentrations in the tunnels adjacent to each port, per se. However, both tunnels are monitored and corrective action is taken when vapor concentrations change. For example, if vapor concentration is decreasing in the tunnels, the frequency of both blower systems is increased. This control method is more expensive than the method described with respect to the preferred configuration since additional ducting and a possible second variable speed frequency drive are required.

The advantages derived through use of the invention will now be considered. Vapor purity levels in a refrigeration enclosure is kept relatively high, as air does not readily enter the enclosure. Low air entrainment into the enclosure yields a more efficient operation since refrigeration is not being expended in cooling the incoming air. Moreover, low air infiltration into an enclosure permits a vapor stream having high purity level to be extracted from the enclosure in a controlled manner for recycling purposes.

One aspect of this invention is the improvement gained through the installation of the control apparatus incorporating the invention near a port of the refrigeration enclosure, preferably at the lowermost port. In particular, the means to redirect the vapor trying to leave the enclosure has been improved. For a spiral refrigeration enclosure, the prior art has utilized fans and ducting to redirect vapor back into the interior of the enclosure, but these systems had limitations in that the exiting vapor flow was manually controlled through use of sliding vanes. The net result was an uneven flow pattern for the vapor stream exiting the refrigeration through the conveyor port. Such a condition required higher flow rates to prevent air infiltration. This invention employs a duct assembly and fan system that draws vapor smoothly away from the enclosure port and redirects it to the interior of the enclosure. As mentioned above, a small amount of vapor leaves through the enclosure port to prevent air infiltration. The reduced vapor flow rates through the enclosure ports become important when the enclosure is part of a recycling system.

The present invention improves on the prior art in the control scheme employed to balance the vapor contained in the enclosure. Prior art systems have used blower systems driven at constant frequency or variable drives. In addition, blower frequency has been tied to injection rate. One limitation to this method is lack of control when there is no injection that results in a subsequent loss of the refrigeration capacity. When blower frequency is tied to a system based on sensing a visible vapor cloud, control becomes dependent on the local relative humidity level. Rooms with low humidity and dry products to be cooled would not have effective control. Temperature sensing has been successfully used in maintaining vapor balance control, so this option is not available per se. None of the mentioned control schemes communicate information from both refrigeration enclosure ports to provide an indication of inflow of air or an outflow of vapor.

The present invention employs a control system utilizing gas analyzers to provide an indication of how well vapor is being contained in the enclosure by monitoring concentrations at both ports. Moreover, the present invention does not have a setpoint based control scheme or a predetermined pattern for the blower frequency. Instead, the blower system responds to purity levels inside the enclosure to achieve optimum frequency.

The present invention further improves on known systems for the recycling of cryogenic vapors. Prior art methods require the generation of sufficient suction pressure at the upper vestibule, which is to be at a pressure level below the lowest pressure in the refrigeration enclosure as well as below atmosphericpressure. Testing of such methods have shown that the amount of makeup air taken from the room is considerable with such a method.

The economic advantage of the present invention is that the controlled extraction of a vapor rich stream does not require large amounts of makeup air and in fact, should reduce the amount of makeup air required in recycle applications. This reduction in makeup air is a cost advantage.

The control scheme of the present invention for recycle applications provide an additional advantage. For example, in U.S. Pat. No. 5,186,008, the amount of vapor withdrawn for recycling purposes is a constant times the injection rate. This implies that the vapor losses from the enclosure fluctuate at a constant times the injection rate. Hence, the vapor losses from the enclosure vary with injection rate.

In the present invention the vapor losses from an enclosure are essentially fixed at some value for a given application. Therefore, the flow of the vapor stream being recycled is not a fixed ratio of the injection rate. The advantage of this control method is more flexibility to define the acceptable range of gas concentrations for a recycle system to be economically feasible.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A system for improving efficiency of a refrigeration enclosure, comprising:

a first port and a second port;

conveyor means for moving product between said first port and said second port;

a refrigerant fluid within said refrigeration enclosure;

a first tunnel encompassing a portion of said conveyor means at said first port, and including an inner length opening into said refrigeration enclosure and an outer length coupled to said first port;

a first recirculation duct means having one opening into said refrigeration enclosure and a second opening coupled to said first tunnel between said inner length and said outer length, for providing a variable flow of said refrigerant fluid therein; and a first monitoring means, including a first sensor juxtaposed to said first port and a second sensor juxtaposed to said second port, for determining respective refrigerant fluid concentrations and for controlling said recirculation duct means, in accord with said concentrations, to vary said flow of refrigerant fluid therein so as to create a refrigerant fluid to air transition zone at said first and second ports and further to cause refrigerant fluid concentrations at said first sensor and at said second sensor to move towards each other.

2. The system as recited in claim 1, wherein said flow of said refrigerant fluid, through said first recirculation duct means, is between said first tunnel and said refrigeration enclosure, and wherein said first monitoring means causes said recirculation duct means to vary an amount of said flow so as to maintain a sufficient flow of said refrigerant fluid through said outer length of said first tunnel to establish said refrigerant fluid to air transition zone.

3. The system as recited in claim 1, further comprising:

vacuum means positioned adjacent to said first port and above said conveyor means, for drawing refrigerant fluid exiting therefrom upward and into a circulation conduit.

4. The system as recited in claim 3, further comprising vacuum means positioned adjacent to said second port.

5. The system as recited in claim 1, wherein said first recirculation duct means comprises a duct and variable speed fan means that is positioned to influence refrigerant fluid flow through said duct, said duct including at least one bend for reducing vortex affects.

6. The system as recited in claim 1, further comprising:

a refrigerant fluid withdrawal port through an exterior wall of said refrigeration enclosure;

recycle duct means positioned adjacent to said withdrawal port for drawing refrigerant fluid from said refrigeration enclosure into a recovery line;

a second monitoring means, including a third sensor positioned within said recovery line, for determining the refrigerant fluid concentration and for controlling said recycle duct means, wherein said second monitoring means controls withdrawal of said refrigerant fluid and cooperates with said first monitoring means to maintain said refrigerant fluid to air transition zone at said first and second ports.

7. The system as recited in claim 1, further comprising:

refrigeration means;

conduit means for coupling said refrigeration enclosure to said refrigeration means; and valve means in said conduit means, coupled to a second monitoring means, for determining the refrigerant fluid concentration within said conduit means, wherein said first monitoring means and said second monitoring means operate said valve means to control refrigerant fluid flow through said conduit means so as to maintain at least one refrigerant fluid concentration at a desired level.

8. The system as recited in claim 1, wherein said refrigerant fluid is carbon dioxide gas and said first port is at a lower elevation than said second port.

9. The system as recited in claim 1, wherein said refrigerant fluid is carbon dioxide gas and said first port and second port are at approximately a same elevation, the system further comprising:

a second tunnel encompassing a portion of said conveyor means at said second port, and including an inner length opening into said refrigeration enclosure and an outer length coupled to said second port;

second recirculation duct means having one opening into said refrigeration enclosure and a second opening coupled to said second tunnel between said inner length and said outer length, for providing a variable flow of said refrigerant gas therein; and wherein said flow of said refrigerant fluid, through both said first recirculation duct means and second recirculation duct means, is into said first and second tunnels, and wherein said first monitoring means causes at least one said recirculation duct means to vary an amount of said flow therein so as to establish in said outer lengths of said tunnels a fluid curtain of said refrigerant fluid.

10. The system as recited in claim 9, wherein said second recirculation duct means comprises a duct and variable speed fan means that is positioned to influence fluid flow through said duct, said duct including at least one bend for reducing vortex affects.

11. The system as recited in claim 9, further comprising:

refrigeration means;

conduit means for coupling said refrigeration enclosure to said refrigeration means; and valve means in said conduit means, coupled to a second monitoring means, for determining the refrigerant fluid concentration within said conduit means, wherein said first monitoring means and said second monitoring means operate said valve means to control refrigerant fluid flow through said conduit means so as to maintain at least one refrigerant fluid concentration at a desired level.

12. The system as recited in claim 9, further comprising:

vacuum means positioned adjacent said first port and above said conveyor means, for drawing refrigerant fluid exiting therefrom upward and into a circulation conduit.

13. The system as recited in claim 12, further comprising vacuum means positioned adjacent to said second port.

14. A method for improving efficiency of a refrigeration enclosure including a first port and a second port, conveyor means for moving product between said first port and said second port, a refrigerant fluid within said refrigeration enclosure, a first tunnel encompassing said conveyor means, and including an inner length opening into said refrigeration enclosure and an outer length coupled to said first port, a first recirculation duct having one opening into said refrigeration enclosure and a second opening coupled to said first tunnel between said inner length and outer length, and first fan means for providing a variable flow of said refrigerant fluid in said first recirculation duct, said method comprising the steps of:

a) sensing a refrigerant fluid concentration in a vicinity of said first port and a refrigerant fluid concentration in a vicinity of said second port; and b) controlling said fan means, in response to refrigerant fluid concentrations sensed in step a), to vary said flow of refrigerant fluid in said first recirculation duct and, accordingly, an amount of refrigerant fluid flow in said outer length, so as to move a refrigerant fluid concentration sensed in said vicinity of said first port and a refrigerant fluid concentration sensed in a vicinity of said second port towards each other.

15. The method as recited in claim 14, wherein said flow of said refrigerant fluid through said recirculation duct is between said first tunnel and said refrigeration enclosure, and wherein said controlling step b) causes said fan means to vary an amount of said flow in said recirculating duct so as to alter said refrigerant fluid concentration at said first port.

16. The method as recited in claim 14, further comprising the step of:

c) applying a vacuum adjacent to said first port, said second port and above said conveyor means, for drawing exiting refrigerant fluid upward from said conveyor means and into a circulation conduit.

17. The method as recited in claim 14, wherein said refrigerant fluid is carbon dioxide gas and said first port is at a lower elevation than said second port.

18. The method as recited in claim 14, wherein said refrigerant fluid is carbon dioxide gas and said first port and second port are at approximately a same elevation, said refrigeration enclosure including a second tunnel encompassing a portion of said conveyor means at said second port, and including an inner length opening into said refrigeration enclosure and an outer length coupled to said second port, a second recirculation duct having one opening into said refrigeration enclosure and a second opening coupled to said second tunnel between said inner length and said outer length, for providing a variable flow of said refrigerant fluid therein; and wherein said flow of said refrigerant fluid, through both said first recirculation duct and second recirculation duct is into said first and second tunnels, and wherein said controlling step b) causes at least one said fan means to vary an amount of refrigerant fluid flow in an associated recirculation duct so as to alter said refrigerant fluid concentration at an associated port.

19. The method as recited in claim 14, wherein said refrigeration enclosure is connected to a refrigerator via a conduit means which includes valving and comprising the further step of:

operating said valving to control refrigerant fluid flow through said conduit means as to maintain at least one said refrigerant fluid concentration at a desired level.

20. The method as recited in claim 14, further comprising the step of, applying a vacuum adjacent to said first port, said second port and above said conveyor means, for drawing refrigerant fluid exiting therefrom upward and into a circulation conduit.

* * * * *